US006986624B1

(12) United States Patent
Tabler

(10) Patent No.: US 6,986,624 B1
(45) Date of Patent: Jan. 17, 2006

(54) POROUS TUBULAR DEVICE AND METHOD FOR CONTROLLING WINDBLOWN PARTICLE STABILIZATION DEPOSITION AND RETENTION

(76) Inventor: Ronald D. Tabler, 7505 Estate Cir., Longmont, CO (US) 80503

( * ) Notice: Subject to any disclaimer, the term of this patent is extended or adjusted under 35 U.S.C. 154(b) by 0 days.

(21) Appl. No.: 10/882,123

(22) Filed: Jun. 30, 2004

(51) Int. Cl.
*E01F 7/00* (2006.01)

(52) U.S. Cl. ..... 405/302.7; 405/302.6; 256/12.5

(58) Field of Classification Search ..... 405/302.4, 405/302.6, 302.7, 15, 35, 34, 33, 32, 21, 405/30, 31; 256/12.5
See application file for complete search history.

(56) References Cited

U.S. PATENT DOCUMENTS

| | | | | |
|---|---|---|---|---|
| 361,783 | A | 4/1887 | Rudnicki | |
| 490,545 | A | 1/1893 | Dixson | |
| 1,108,943 | A | 9/1914 | Swezey | |
| 1,175,962 | A | 3/1916 | Latham | |
| 1,281,021 | A | 10/1918 | Kellner | |
| 1,281,022 | A | 10/1918 | Kellner | |
| 1,355,051 | A | 10/1920 | Kellner | |
| 1,373,629 | A | 4/1921 | Nohlen | |
| 1,487,668 | A | 3/1924 | Rehfeld | |
| 1,489,647 | A | 4/1924 | Nohlen | |
| 1,541,241 | A | 6/1925 | Baxter | |
| 1,545,909 | A | 7/1925 | McKinnon | |
| 1,595,946 | A | 8/1926 | Kellner | |
| 1,627,623 | A | 5/1927 | Smith | |
| 1,635,899 | A | 7/1927 | Nohlen | |
| 1,668,651 | A | 5/1928 | McKinnon | |
| 1,819,305 | A | 8/1931 | Snyder | |
| 1,969,123 | A * | 8/1934 | Doble | 405/32 |
| 2,032,582 | A | 3/1936 | Lashmet | |
| 2,082,707 | A | 6/1937 | Mahon | |
| 2,092,183 | A | 9/1937 | Rehfeld | |
| 2,135,337 | A * | 11/1938 | Herbest, Jr. | 405/32 |
| 2,248,721 | A | 7/1941 | Rehfeld | |
| 2,263,313 | A | 11/1941 | Rehfeld | |
| 2,306,737 | A | 12/1942 | MacDonald | |
| 2,378,865 | A | 6/1945 | Rehfeld | |
| 2,803,113 | A | 8/1957 | Hoad | |
| 2,803,437 | A | 8/1957 | Borges | |
| 3,218,035 | A | 11/1965 | Dunlap | |
| 3,226,091 | A | 12/1965 | Root | |
| 3,540,587 | A | 11/1970 | Dawbarn | |
| 3,844,124 | A | 10/1974 | Tupper | |
| 3,913,889 | A | 10/1975 | Nugent et al. | |
| 3,966,172 | A | 6/1976 | Garrett | |
| 4,335,868 | A * | 6/1982 | Ribbert | 256/12.5 |

(Continued)

FOREIGN PATENT DOCUMENTS

| | | |
|---|---|---|
| DK | 61263 | 8/1943 |

(Continued)

*Primary Examiner*—Frederick L. Lagman
(74) *Attorney, Agent, or Firm*—John R. Ley; Spencer A. Gibbs

(57) ABSTRACT

Windblown particles are controlled by a porous tubular control device formed from a sheet of netting material having a plurality of interconnected webs which define a plurality of apertures. The sheet of netting material assumes a three-dimensional tubular configuration. The tubular configuration is oriented to confront the wind and cause the wind blown particles to flow through the apertures of two vertically oriented portions of the tubular netting sheet to create aerodynamic drag and turbulence altering effects which stabilize, deposit and retain the windblown particles. The control device is effective in preventing the wind erosion of snow, sand or dust over an area much greater than the area occupied by the device.

66 Claims, 16 Drawing Sheets

U.S. PATENT DOCUMENTS

| | | | | |
|---|---|---|---|---|
| 4,339,114 | A | 7/1982 | Deike | |
| 4,388,019 | A | 6/1983 | Kajihara | |
| 4,439,059 | A | 3/1984 | Kikuzawa et al. | |
| 4,529,173 | A | 7/1985 | Kramer et al. | |
| 4,549,724 | A | 10/1985 | Taillandier | |
| 4,932,634 | A | 6/1990 | Sura | |
| 4,947,791 | A | 8/1990 | Laier et al. | |
| 4,954,013 | A | 9/1990 | Lamberton | |
| 5,039,250 | A | 8/1991 | Janz | |
| 5,123,780 | A | 6/1992 | Martinsen | |
| 5,131,630 | A | 7/1992 | Nash | |
| 5,184,800 | A | 2/1993 | Tabler | |
| 5,405,217 | A | 4/1995 | Dias et al. | |
| D360,476 | S | 7/1995 | Smeja et al. | |
| 5,556,229 | A | 9/1996 | Bishop et al. | |
| 5,605,416 | A | 2/1997 | Roach | |
| 5,901,507 | A | 5/1999 | Smeja et al. | |
| 6,497,532 | B1 * | 12/2002 | McGinn | 405/33 |
| 6,616,383 | B2 | 9/2003 | Janz | |
| 6,824,681 | B2 * | 11/2004 | Engwer | 405/302.7 |

FOREIGN PATENT DOCUMENTS

| | | |
|---|---|---|
| DK | 81858 | 9/1956 |
| DK | 85909 | 10/1958 |
| FR | 2625520 | * 7/1989 |
| JP | 5997909 | 6/1984 |
| JP | 2289705 | 11/1990 |
| JP | 6264415 | 9/1994 |
| JP | 6264418 | 9/1994 |
| JP | 841830 | 2/1996 |
| JP | 8109616 | 4/1996 |
| JP | 08277008 | * 10/1996 |
| JP | 11229331 | 8/1999 |
| JP | 200269935 | 3/2002 |
| RU | 687164 | 10/1978 |
| SU | 629277 | 9/1978 |
| SU | 687165 | 10/1979 |

* cited by examiner

POROUS TUBULAR DEVICE AND METHOD FOR CONTROLLING WINDBLOWN PARTICLE STABILIZATION DEPOSITION AND RETENTION

This invention relates to controlling the deposition and retention of windblown particles, such as snow, sand or soil. More particularly, the present invention relates to a new and improved control device and method which utilizes a three-dimensional porous tubular configuration to efficiently and inexpensively separate windblown particles from the wind and deposit and retain those particles in a manner which achieves desired control effects, such as preventing large accumulations of snow across roadways and railroad tracks, retaining and stabilizing snow adjacent to roadways to prevent the snow from sifting on to the road and melting and thereafter freezing as ice on the roadway, increasing the amount of snow on disturbed lands or agricultural fields to increase the soil moisture content for improving plant growth, retaining topsoil in agricultural fields to prevent wind erosion, and any other applications where windblown particles must be removed from airflow or retained and stabilized against movement in an airflow.

BACKGROUND OF THE INVENTION

Windblown snow, sand, and dust can create hazardous driving conditions by reducing visibility and forming drifts on the roadway that block or impede traffic movement. Blowing snow also causes icy roads, which are a major cause of vehicle accidents. Blowing snow also causes significant problems on railroads by forming drifts that block the passage of trains where tracks pass through cuts in hills, and by clogging switches and interfering with the operation of electronic sensors for detecting over-heated journals and dragging equipment.

To alleviate the problems created by blowing and drifting snow, snow control devices in the form of snow fences and other structures have been used for more than 100 years. A snow fence causes the wind-borne snow crystals or particles to settle out of the wind in a protected or sheltered area other than at the critical area of the roadway or railroad tracks where snow accumulation is not wanted. The typical construction of a snow fence is a two-dimensional panel with a series of slots, holes or openings formed through the panel to create porosity. The snow fence creates aerodynamic drag and alters the structure of the turbulence which slows the velocity of the wind and diminishes its capacity to carry snow. In addition, a porous snow fence reduces the scale of turbulence by breaking up large eddies into smaller ones. These effects on the airflow allow the suspended particles to settle out and accumulate in an area which is protected or sheltered by the snow fence. In the case of a porous fence, most of this deposition occurs on the downwind side of the barrier or panel. By positioning the snow fence far enough away from the roadway, the snow settles out of the wind at the sheltered or protected area. The wind is relatively free of snow close to the protected area so no further snow accumulates at the critical area of the roadway. However, because the wind will pick up additional snow particles by blowing over expanses of snow-covered ground, the snow fence and its protected area must be close enough to the roadway or other critical area to prevent the wind from accumulating snow again before reaching the roadway or critical area. Otherwise, the placement of the snow fence will be ineffective in preventing snow accumulation on the roadway or critical area.

Typically, the panels of a snow fence are assembled in long continuous rows, which are visually obtrusive and aesthetically objectionable in a natural environment. The panels should be situated generally perpendicular to the prevailing wind direction to achieve the maximum effectiveness. The effectiveness of a two-dimensional fence decreases as the angle between the wind direction and the fence alignment decreases below approximately 60 degrees. The holes or slots are sometimes prone to clogging with snow, which reduces the effectiveness of the snow fence. The panels are typically constructed of wood, steel or plastic sheeting and the panels are attached to the ground by posts or by triangular support frame structures to hold up the panels. Conventional snow fences require time-consuming field fabrication and installation, and are often prohibitively expensive. Their use is often restricted by the need to place the fences outside of the existing right-of-way and the reluctance of landowners to grant the necessary easements. Because of the difficulty and cost of assembling these types of snow fences, they are generally not removed during those seasons of the year when they are not needed. Consequently, the snow fences create an obtrusive unnatural environmental impact on a year-round basis. Furthermore, an errant vehicle that accidentally departs the roadway and collides with one of these snow fences may incur serious damage and possibly injure the occupants as a result of the bulk and rigidity of materials used to construct the snow fences.

Natural vegetation such as trees and brush are sometimes planted adjacent to roadways and railroads and at other locations to create natural windblown particle control obstacles. While often effective when mature, the natural vegetation remains ineffective until it has grown to a size capable of interacting with the wind. The time to achieve this growth may be significant, particularly where growing conditions are suboptimum. Moreover, not all of the planted vegetation survives and attains a size sufficient to control windblown particles. It is not practical to move or adjust the positioning of the natural vegetation after it has been planted to obtain the best control benefits. The soil types and weather conditions in some locations preclude the use of natural vegetation for controlling windblown particles. Consequently, man-made artificial structures are often preferred for use to control windblown snow because they can be placed where needed and are immediately effective. It is theoretically possible to remove the artificial structures during the seasons of the year when they are not needed, although the reality is that these artificial structures are rarely if ever removed once constructed because of the cost and inconvenience of doing so.

Because of the cost, obtrusiveness and removal difficulties associated with most of these artificial snow fences and particle-control structures, they are not prevalently used for other beneficial purposes such as accumulating snow in agricultural fields to increase the soil moisture content for growing crops, retaining the topsoil against wind erosion, or shielding immature plants from the shear stress of wind and rapid evaporation of soil moisture at their critical early-growth stages. These and other beneficial uses of windblown particle control devices would become more prevalent if the cost of the control devices were reduced so that more of them could be used to create beneficial effects throughout large expanses of the agricultural fields, if the ability to assemble and disassemble the devices was enhanced so that the devices could be removed after stable plant growth had been established and to permit harvesting of the crops, and if the cost-benefit considerations of using such devices were more pronounced, among other things.

In addition to controlling windblown particles, various silt and sediment control devices and artificial reef structures have been devised to deposit and control silt, sediment and other water-borne particles in moving bodies of water. In general, however, the fluid dynamic drag and turbulence effects necessary to control water-borne particles are much different than the effects necessary to control windblown particles. For example, the fluid dynamic effects are related to the density of the medium in relation to the density of the transported particles, and the square or cube of the flow velocity. The density of water is approximately 1000 times that of air and the velocity of snow-transporting wind is typically 10 times the speed of sediment-transporting water. These considerations indicate magnitudes of difference in the fluid dynamic effects, thereby suggesting that the structures which are effective in controlling water-borne silt are essentially ineffective and inapplicable to controlling windblown particles.

SUMMARY OF THE INVENTION

The present invention involves stabilizing a surface against wind erosion and controlling windblown particles in an effective and relatively inexpensive way by the use of a porous tubular windblown particle control device and a method which makes use of such a porous tubular control device. The porous tubular control device may be constructed relatively quickly and inexpensively from common materials by bringing the construction materials to the site where the control devices are to be used, or by preassembling the control devices and transporting them to the site where they will be used. The porous tubular control device assumes a shape and color which blends with the natural habitat in which it is used. The structure of the porous tubular control device facilitates its disassembly for removal during those seasons of the year when it is not needed, or facilitates its transportation and storage in an assembled state so that it can be easily deployed when needed again. The structure of the porous tubular control devices makes it easy to move them to achieve the best windblown particle control effect. The porous tubular control devices are constructed of materials which do not present a significant collision hazard from errant vehicles which leave a roadway, but instead attenuate or diminish the velocity of the errant vehicles and thereby reduce the risk of damage to the vehicle and its occupants. Significantly, however, the porous tubular control devices are very effective in stabilizing a surface against wind erosion and depositing and retaining windblown particles carried by wind blowing from a relatively wide range of wind direction angles. The relatively inexpensive and effective nature of the porous tubular control devices facilitate their use in many other applications, such as protecting topsoil from wind erosion, and facilitating the revegetation of disturbed areas by increasing soil moisture and protecting plant growth from wind, sun and animal grazing.

The porous tubular control devices of the present invention may also be used to make beneficial use of a discovery that maintaining and stabilizing the snowcover adjacent to a roadway is essential in avoiding dangerous roadway icing conditions. The most prevalent prior use of snow control devices has been to deposit snow away from the roadway to prevent accumulations on the roadway itself. Not fully recognized or utilized for purposes of roadway safety is the discovery that snow which continually sifts across the roadway is a significant cause of roadway icing. The roadway absorbs solar energy and is usually warmer than the surrounding air during daylight hours. Blowing snow coming in contact with the pavement melts, forming a layer of water and extracting heat in the process. With the wind continually sifting snow over the roadway, the thermal energy is removed from the roadway pavement by melting the snow faster than solar energy is absorbed by the roadway, thereby causing the layer of liquid water to refreeze into a thin layer of ice over the roadway. The implication of the discovery that continually sifting snow is a major cause of roadway icing, is that the snow control devices must not only prevent the accumulation of snow on the roadway, but should also stabilize the roadside snowcover to prevent the snow from continually sifting over the roadway even in amounts which would not otherwise impede traffic.

In accordance with these and other considerations, the present invention is directed to a tubular porous windblown particle control device and method for controlling the deposition and retention of windblown particles, such as snow. The porous tubular windblown particle control device comprises a plurality of longitudinally separated frame structures defining an outer peripheral shape and arranged horizontally in series, and a sheet of netting material having a plurality of interconnected webs which define a plurality of apertures. The method for controlling the deposition and retention of windblown particles involves using a porous tubular windblown particle control device of this nature. The method also involves locating the control device upwind from an area that is to be protected from the windblown particles, positioning the control device with the longitudinal axis of the porous tubular configuration extending generally parallel to the earth surface, and orienting the tubular configuration of the sheet of netting material to confront the wind and cause the wind blown particles to flow through the apertures of the sheet of netting material to create aerodynamic effects which deposit and maintain the particles on the earth surface within the protected area, which extends upwind and downwind from the tubular control device for a total distance equal to approximately forty times its height.

Preferably, the sheet of netting material is extruded with interconnected webs which each present a three-dimensional characteristic, and the self-supporting strength of the sheet of netting material is imparted by the three-dimensional characteristics of the webs. The strength of the sheet of netting material maintains the tubular configuration without longitudinal bracing between the frame structures, even under the influences of wind loading. The three-dimensional characteristics of the webs and the apertures increase the aerodynamic drag and enhance the dissipation of the force of the wind on the surface in the vicinity of the tubular device.

The outer peripheral shape of the frame structures may be substantially D-shaped, U-shaped or O-shaped. An anchor element is connected to the frame structure and receives a fastener to connect the anchor element, the frame structure and the device to the earth surface. A longitudinal restraint element may be connected to each of the frame structures and extend beyond the longitudinal dimension of the sheet of netting material to provide a secondary longitudinal restraint in the event the fasteners anchoring the individual frames come loose from the ground.

Preferably, the tubular configuration of the control devices is oriented with its longitudinal axis generally perpendicular to a prevailing wind direction, although such an orientation is not critical because the tubular configuration presents the two vertical segments to confront the wind over a wide variety of wind direction angles. A plurality of control devices may be positioned in a row to protect an area that is larger than the area capable of being protected by a single control device. All of the control devices in the row may be commonly longitudinally restrained to the earth surface. The row may be continuous, discontinuous, linear or curved to best protect an area from the windblown particles. The color of the sheet of netting material is preferably selected to blend with a natural ambient environment adjacent to the location of the control device.

The porous tubular windblown particle control devices are fabricated from relatively inexpensive materials, and each control device can be assembled and disassembled in a relatively quick and efficient manner. As result, the cost of deploying the control device relative to the significant advantages obtained from use of the control devices are substantial. The porous tubular configuration of the control device achieves substantial deposition of windblown particles and stabilization of snowcover, sand or soil, despite its relatively inexpensive nature.

A more complete appreciation of the scope of the invention and the manner in which it achieves the above-noted and other beneficial effects, advantages and improvements can be obtained by reference to the following detailed description of presently preferred embodiments of the invention taken in connection with the accompanying drawings, which are briefly summarized below, and by reference to the appended claims.

DETAILED DESCRIPTION

Figure 1:
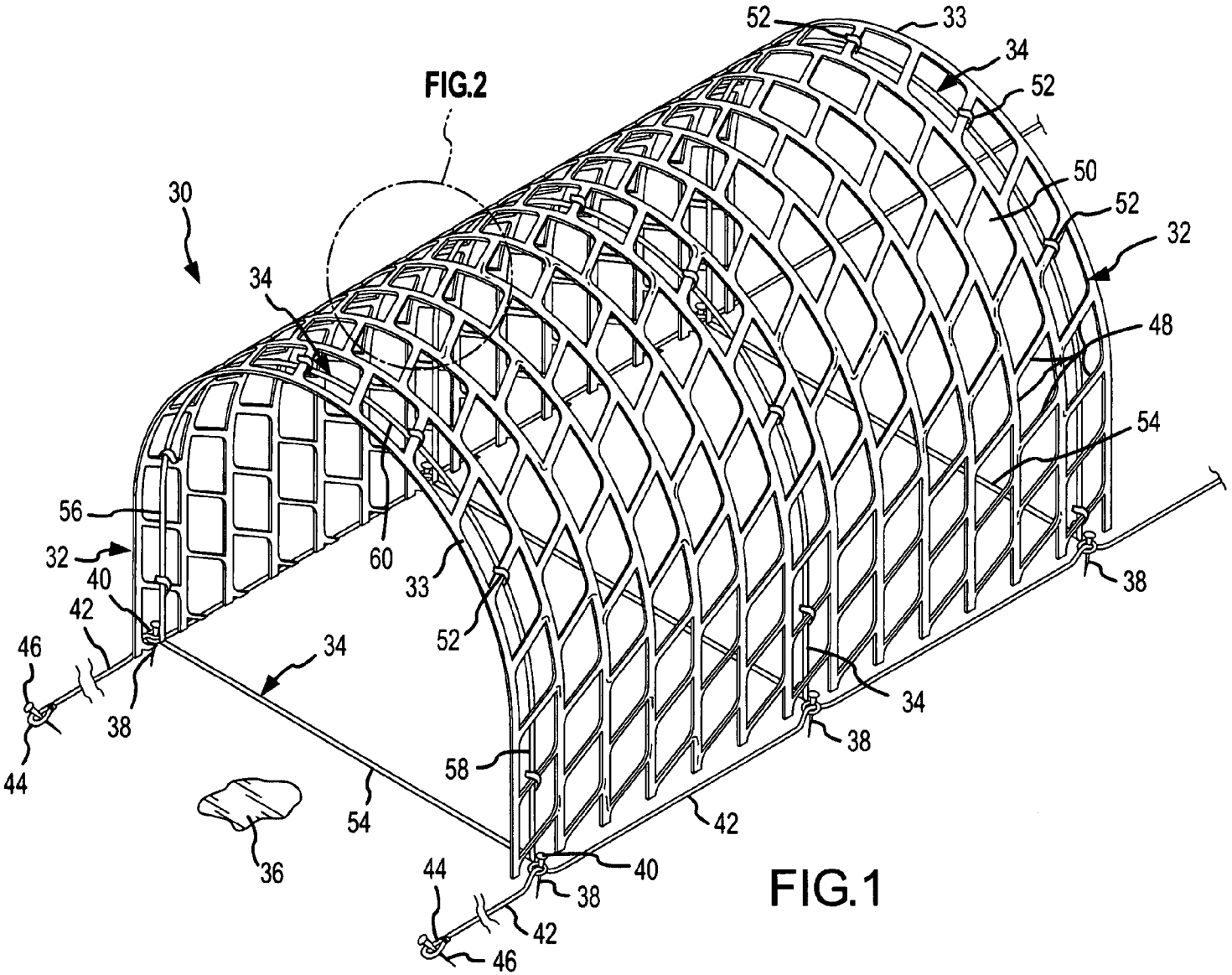
FIG. 1 is a perspective view of a porous tubular windblown particle control device incorporating the present invention.
Figure 2:
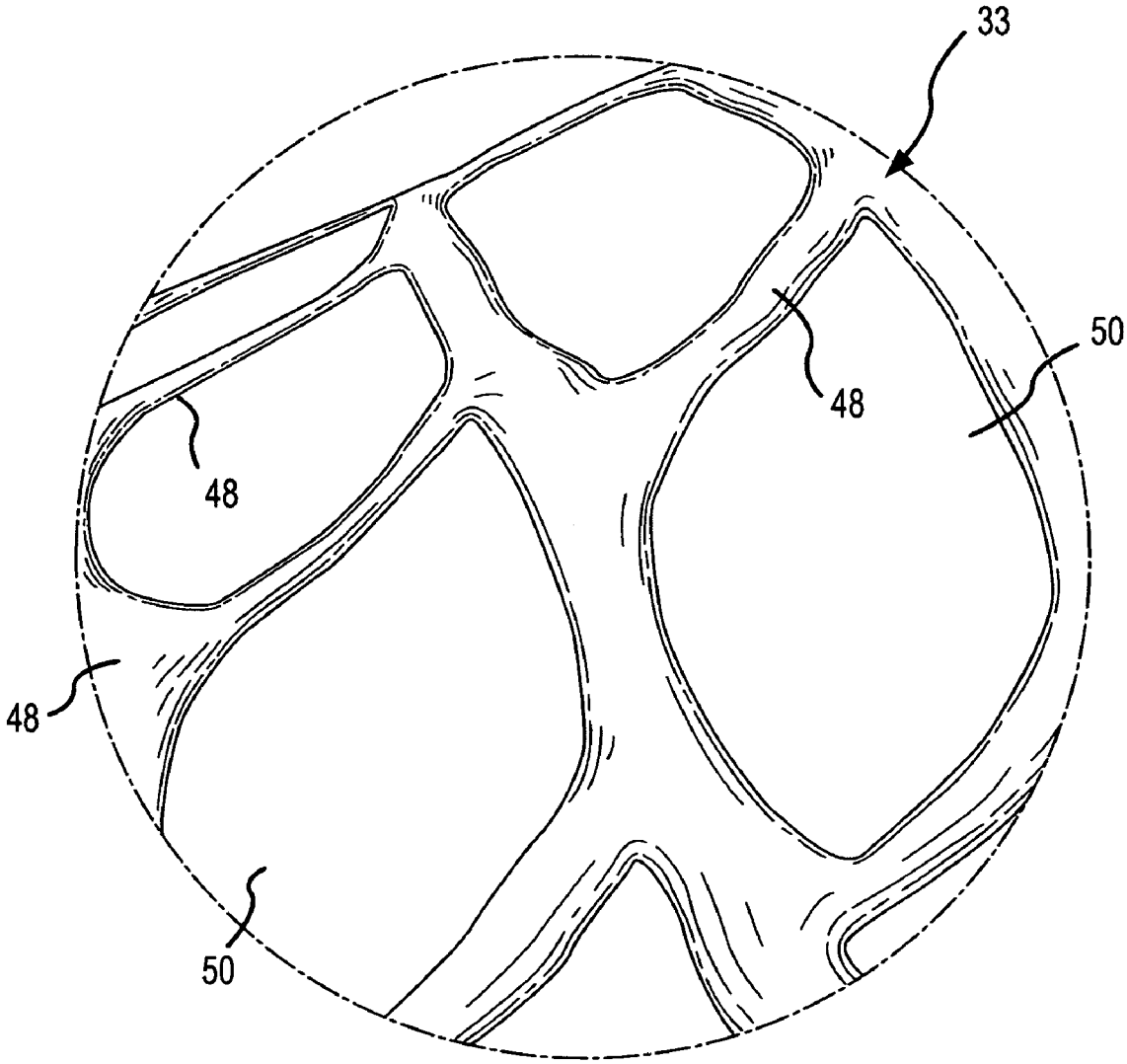
FIG. 2 is an enlarged view of a segment of extruded plastic netting material of the control device shown in FIG. 1.

One form of a porous tubular windblown particle control device 30 incorporating the present invention is shown in FIGS. 1–5. The control device 30 is generally formed by a sheet 32 of conventional, flexible, extruded plastic netting material 33 which is connected to and supported by a support structure formed from a plurality of D-shaped frame structures 34 that are longitudinally spaced apart from one another in a series along the length of the netting sheet 32. The strength of the sheet 32 of netting material 33 and the D-shaped frame structures 34 establish and maintain the general overall three-dimensional tubular shape and configuration of the device 30.

The device 30 is secured in a desired position on the earth surface or ground 36 or other earth surface by an anchor system which includes frame spikes 38 that are inserted through anchor elements or loops 40 formed in the frame structures 34. The frame spikes 38 are driven through the anchor loops 40 and into the ground 36 to secure the frame structures 34 and thus the entire device 30 to the ground. The anchor system may also include at least one longitudinal restraint element or cable 42 that connects to the frame structures 34, such as by extending through the anchor loops 40 along with the frame spikes 38. Opposite longitudinal ends of the restraint cable 42 are formed with restraint connectors or loops 44 into which restraint spikes 46 are inserted and driven into the ground 36. The longitudinal restraint cable 42 functions primarily as secondary anchoring to maintain the device 30 from blowing away, if the primary anchoring from the frame spikes 38 is lost. A plurality of the windblown particle control devices 30 may be arranged in an end-to-end sequential manner or row (FIG. 5) and restrained by at least one common longitudinal restraint cable 42 connected to the frame structures 34 of all of the devices 30 in the row.

The principal use of all forms of the porous tubular windblown particle control devices of the present invention, is to stabilize snow cover, and to control and retain windblown snow. Controlling and retaining or stabilizing windblown snow is very important to keeping roadways passable to traffic by preventing snow drifts and large accumulations which block the roadways to traffic flow. Controlling and retaining windblown snow is equally or more important to prevent icing on roadways, as would occur by the continuous sifting of snow across the roadway where the snow melts and then refreezes to form ice. Ice on roadways causes or contributes to vehicle crashes because of the inability of drivers to control their vehicles under icing conditions.

These functions are achieved by diminishing the velocity of the wind and altering turbulence in the airflow due to the characteristics and shape of the netting sheet 32. The diminished wind velocity and altered turbulence causes the windblown particles to settle out of the airflow to the ground 36 where they are retained in a protected area due to the diminished wind velocity and altered airflow turbulence. The protected area extends upwind and downwind of the control devices, and may attain a total length of approximately 40 times the height of the control device.

The sheet 32 of netting material exhibits sufficient strength to withstand the wind and to alter turbulence effects within the wind. The strength of the netting sheet 32 is sufficient to support the small amount of particles that might accumulate on the netting sheet 32 under conditions of still-wind particle deposition. The preferred material 33 of the netting sheet 32 is shown in more detail in FIG. 2. The material 33 is a conventional extruded plastic netting material currently manufactured by Masternet, Ltd. of Mississauga, Ontario, Canada, under the trademark "Vexar," and previously manufactured by Dupont Liquid Packaging Systems of Whitby, Ontario, Canada.

The netting material 33 is extruded in the sheets 32, and is formed by a plurality of linked webs 48 which connect together to define apertures 50 between the webs 48. The size of the apertures 50 is considerably greater than the size of the webs 48. The webs 48 and the apertures 50 create a netting characteristic of each sheet 32 of material 33. The netting material may be fabricated in continuous or sizable pieces, with the larger pieces cut to the size of the smaller sheets 32 suitable for each device 30.

Each of the webs 48 has a three-dimensional characteristic, with significant length, width and thickness dimensions, due to the extrusion process used to fabricate the sheets 32 of material 33. The width and thickness dimensions of the webs 48 are primarily responsible for the strength of the netting sheets 32. The thickness dimension (measured perpendicular to the plane of a flat sheet of the netting material) of each web 48 is substantial enough to self-support the netting sheet 32 between the D-shaped frame structures 34. The strength of the webs 48 establishes the ability of the sheet 32 to support itself between the frame structures 34, to resist the forces from wind-loading, and to maintain the overall tubular configuration of the device 30.

The apertures 50 in the netting sheet 32 are relatively large and allow a majority of vertically-falling snow in still-wind conditions to pass through those apertures 50 without accumulating on the webs 48. The strength of the webs 48 is sufficient to resist that small amount of snow which may accumulate on them under such conditions, without substantially deforming the overall shape of the device 30. The apertures 50 also allow snow that is blowing generally horizontally to pass through the device 30 while reducing the velocity of the wind and altering turbulence which cause the snow to settle near the device 30.

The width, thickness in length of each web 48 is substantially nonuniform among substantially all of the other webs 48 of the netting sheet of 32. Similarly, the size of each aperture 50 within the netting sheet 32 is substantially nonuniform among substantially all of the other apertures 50 of the netting sheet 32. Even though the webs 48 are nonuniform, the width, thickness and length of those webs typically averages ¾, ¼ and 3 inches, respectively. Similarly, although each aperture 50 is also nonuniform, the cross-sectional area occupied by each aperture typically averages about 10 square inches. Consequently, the porosity of the extruded plastic netting material 33 generally falls within the range of 50%.

The uneven and nonuniform width, thickness and length dimensions of the webs 48 contribute to altering the turbulence and reducing the velocity of the wind blowing through the device 30. However, netting sheets with uniform webs and apertures, such as a geotech grid or thick punched and drawn sheeting, can be employed, provided that alternative material has adequate strength capability to reduce wind velocity and alter the turbulence. The reduction in velocity and the turbulence effects cause the removal of a significant portion of the windblown particles from the wind, and the deposition of the removed windblown particles adjacent to and downwind of the device 30. The removed particles are retained on the ground 36 in substantially the protected position where they are deposited upwind and downwind near the device 30, due to the reduction in wind velocity and turbulence effects in the protected area near the ground 36.

Because of the tubular shape of the device 30, the relatively large apertures 50, and the three-dimensional nature of the webs 48, the device 30 maintains its ability to induce deposition of windblown particles through a wide range of wind direction angles relative to the longitudinal axis. Indeed, the three-dimensional nature of the device 30 makes it much more effective than conventional two-dimension snow fence when winds are aligned with the longitudinal axis. This capability to control windblown particles through a relatively wide range of wind direction angles offers a significant advantage over most conventional snow fences which are functional only over a considerably narrower range of wind direction angles. The color of the sheets 32 of netting material 33 may also be selected to blend with the natural environment in which the devices 30 are placed, thereby minimizing negative aesthetic impacts on the environment. This again is an advantage over conventional snow fences which are generally mechanical-appearing, obtrusive in appearance and incapable of blending with the natural environment.

The above-described advantages achieved by the extruded plastic netting material 33 used in the control device 30 cannot be achieved, or cannot be achieved to the significant degree as obtained by the present invention, by thin-sheet plastic netting material. Such thin sheet material generally lacks the strength and durability to support itself between the frame structures and to withstand the wind loading necessary to reduce the wind velocity and alter the turbulence. The thin uniform dimensions of the material between the holes in the sheets are not as effective in creating the wind velocity reduction and turbulence altering effects as are desirable and beneficial from the present invention and the thin material is generally incapable of supporting the weight of fallen snow.

Figure 3:
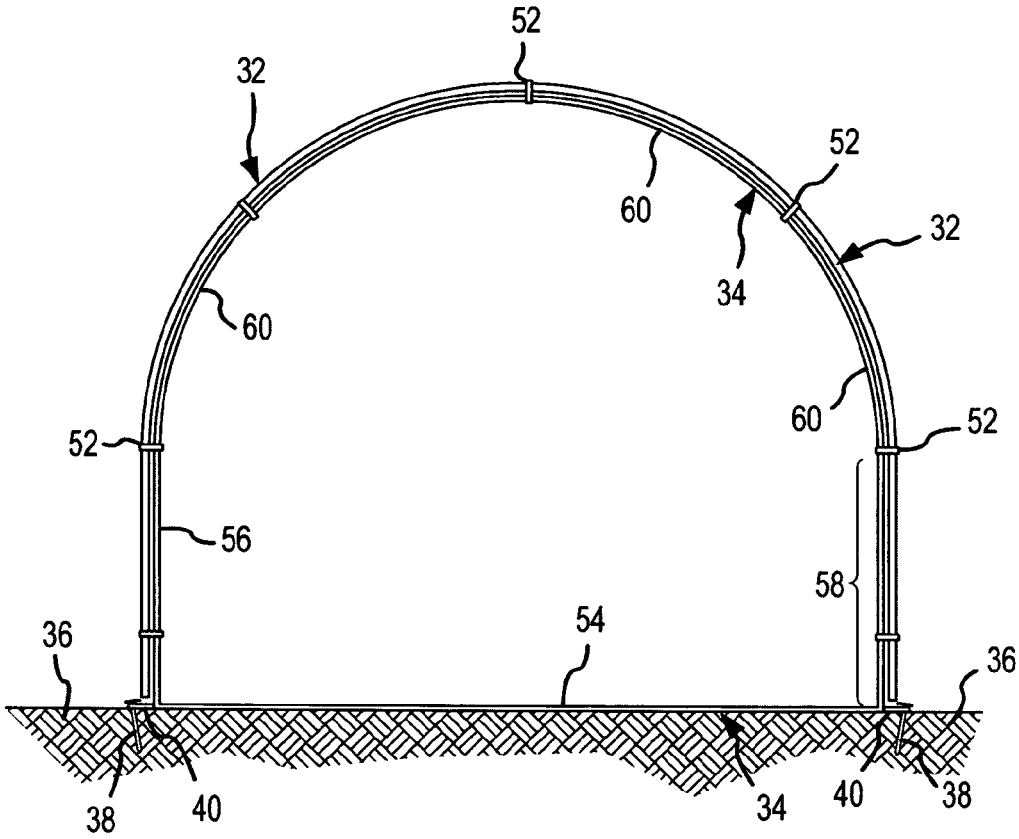
FIG. 3 is an end elevation view of the control device shown in FIG. 1.
Figure 5:
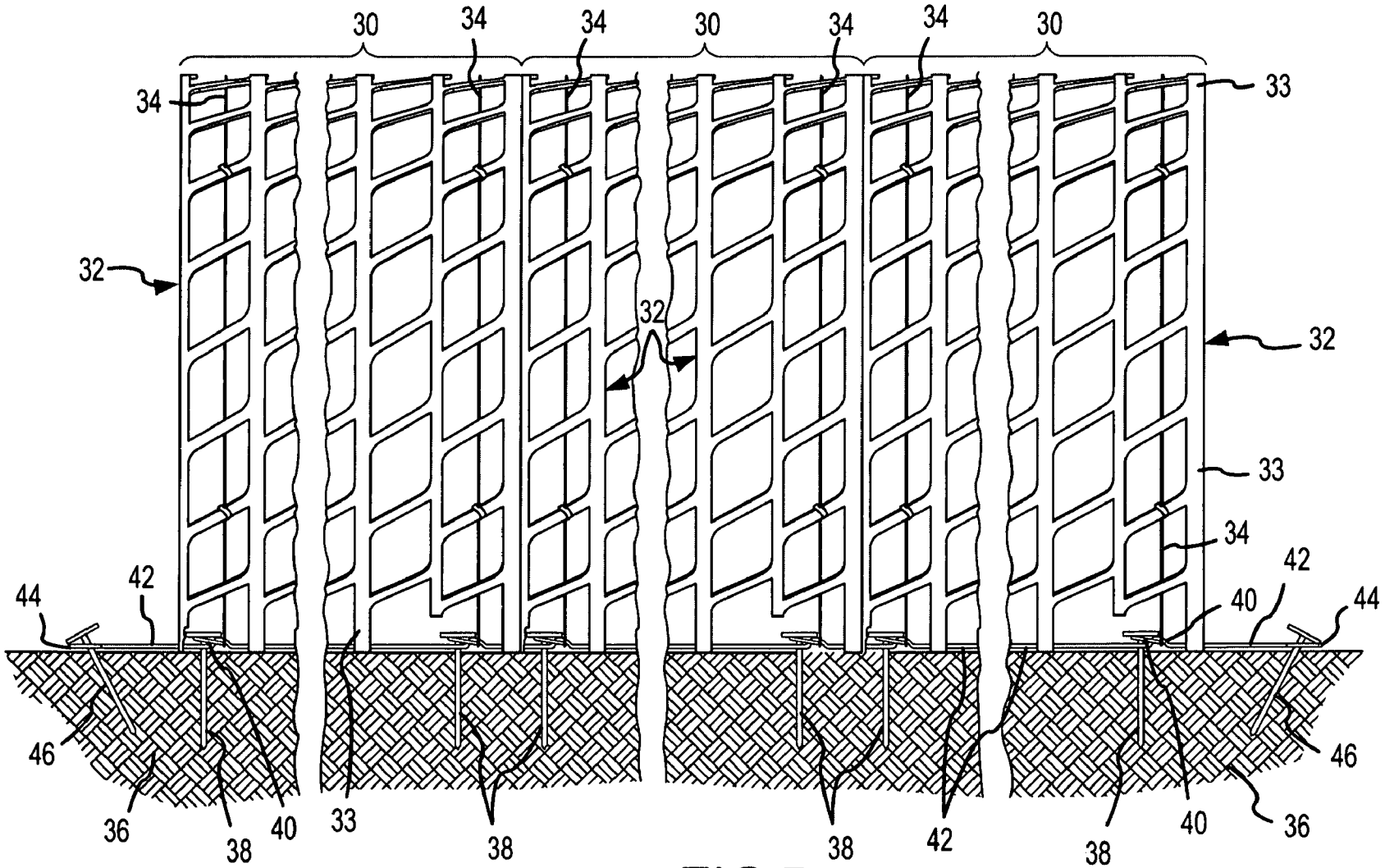
FIG. 5 is a side elevational view of a plurality of the control devices shown in FIG. 1, positioned in an end-to-end manner, with longitudinal segments of each control device broken out.

The extruded netting sheet 32 is attached to the D-shaped frame structures 34 by netting connectors 52, shown in FIGS. 1, 3 and 5. Each connector 52 is preferably a short length of relatively heavy gauge steel wire that is wrapped around one of the webs 48 and one of the frame structures 34. For example, each connector may take the form of a conventional "hog-ring" that is bent to enclose a web 48 around the frame structure 34. The netting connectors 62 can also be a resilient plastic clip, strap or other material that does not break down or decompose when exposed to weather and sunlight and which is strong enough to hold the netting sheet 32 to the frame structures 34 under substantial wind conditions. Netting connectors 52 connect the webs 48 of the netting sheet 32 to each structure 34 at a multiplicity of spaced apart points along each frame structure 34. The frame structures 34 may have V-shaped notches, indentions or other restraints (not shown) formed along their length which provide attachment points for the connectors 52. Such notches, indentions or restraints secure the connectors 52 in position on the frame structure 34 to maintain the position of the netting sheet 32 without slipping on the frame structures 34.

Each frame structure 34 is formed generally in the outer peripheral shape of an alphabetical letter "D," as shown in FIGS. 1 and 3. The D-shaped frame structure 34 has a straight base portion 54 which contacts and extends along the ground 36, two relatively straight leg portions 56 and 58 which extend substantially perpendicularly from the base portion 54 and vertically from the ground 36, and a semicircular portion 60 which connects the upper ends of the leg portions 56 and 58 with its concave side facing the base portion 54. The portions 54, 56, 58 and 60 establish an open center through the D-shaped frame structure 34. The size and configuration of all of the D-shaped frame structures 54 in each device 30 are essentially identical, and are also preferably identical among different devices 30.

With the netting sheet 32 connected to the D-shaped frame structures 34, the netting sheet 32 conforms to the shape of the frame structures 34. The netting sheet 32 is sufficiently flexible to be deformed to take on the shape of the frame structures 34, thereby forming the three-dimensional tubular shape of the device 30. The semicircular portion 60 of the frame structure 34 causes the netting sheet 32 to have a shape similar to a half cylinder at the top of the device 30. The half-cylindrically shaped top of the device 30 is spaced from the ground 36 by the length of each leg portion 56 and 58. The netting sheet 32 extends downward from the semicircular portion 60 of the D frame structures 32 along the length of the leg portions 56 and 58. The netting sheet 32 terminates at the lower end of the leg portions 56 and 58 adjacent to the ground 36. The netting sheet 32 need not terminate immediately adjacent to the ground 36, but may be spaced at a distance above the ground. Spacing the lower end of the netting sheet 32 a slight distance above the ground may not diminish the effectiveness of the device 30 in controlling windblown particles, because the wind velocity near the ground is reduced naturally. The netting sheet 32 also extends longitudinally along and between each of the spaced apart D-shaped frame structures 34. The netting sheet 32 also extends slightly longitudinally beyond the outermost ones of the frame structures 32, thereby establishing open ends of the device 30 at opposite longitudinal ends.

The radius of curvature of the semicircular portion 60 and the length of each leg portion 56 and 58 between the base portion 54 and their transitions to the semicircular portion 60 establishes the overall height of the device 30 from the ground 36. The overall height of the device 30 is established in consideration of the strength of the wind, typical depth of the snowcover, the height of the natural vegetation, and in the case of controlling windblown particles, the estimated mass flux of transported material that must be deposited, in the particular locale where the device 30 is used. Typically, the device 30 has an overall height of two to four feet when secured to the ground 36, and a length of four to six feet.

The straight base portion 54 of the frame structures 34 helps to stabilize the device 30 against wind forces by its contact with the ground 36 to resist any tendency of the device 30 to tip or roll under the influence of wind loads. The half-cylinder upper shape of the device 30 also helps to reduce deformation from wind loads and particle accumulation by transmitting the force to the vertical leg portions 56 and 58 and to the ground 36.

The frame structures 34 are each preferably made from galvanized steel wire to impart enough structural strength to support the netting sheet 32 and to withstand the forces created by blowing wind. A single length of such wire may be used to form each frame structure 34 as an integral unit. A single length of wire is formed into the shape of the frame structure 34 and its free ends are thereafter welded or coupled together to form an integral endless configuration of the frame structure 34. Other materials, such as solid plastic or plastic tubing, may also be used for constructing the frame structures 34 provided that they possess the necessary strength characteristics to support the netting sheet 32 without substantial deformation.

Although the base portions 54 of the frame structures 34 contact the ground 36 and help support the device 30, it is the anchor system that provides the primary attachment of the device 30 to the ground 36. The anchor system also permits the frame structures 34 to resist wind loads by securing the frame structures 34 to the ground 36.

Figure 4:
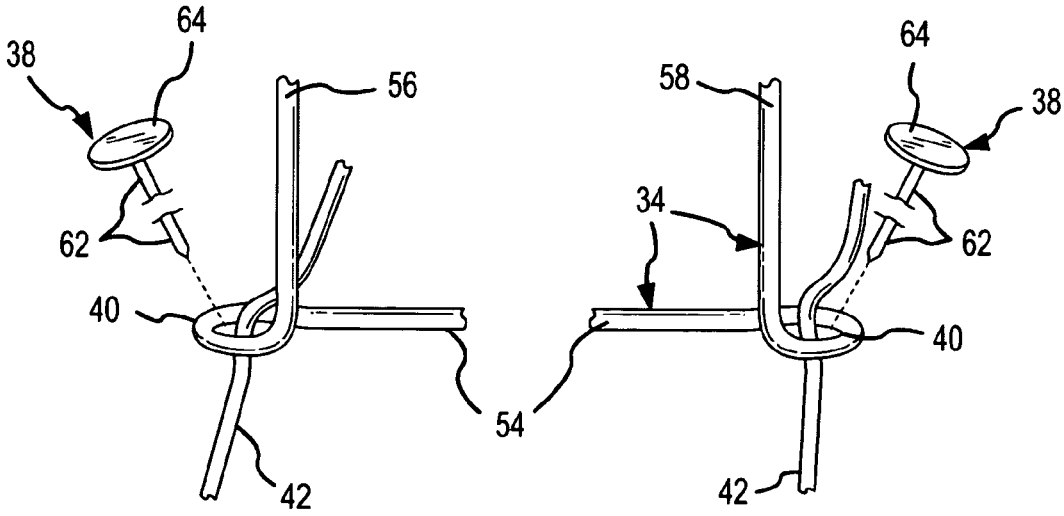
FIG. 4 is an enlarged and partial perspective view of a frame structure and an anchor system for the control device shown in FIG. 1.

The anchor system includes the anchor loops 40 which are formed as part of the frame structures 34 at the corners where the base portion 54 intersects with the leg portions 56 and 58, as shown in FIGS. 1 and 3–5. The anchor loops 40 are preferably formed by twisting an overlapping anchor loop 40 into the frame structure 34 at the junction of each leg portion 56 or 58 with the base portion 54, as shown in FIG. 4. Separate rings to form the anchor loops 40 could also be welded to the corner intersection of each leg portion 56 or 58 with the base portion 54, but forming the anchor loops 40 by an overlapped twisted portion of the same wire which forms the frame structure 34 is more convenient and less expensive.

The frame spikes 38 are driven through the anchor of loops 40 to secure the frame structure 34 to the ground 36. Each frame spike 38 is preferably formed with a galvanized steel shaft 62 attached to a head 64. The head 64 is larger than the anchor loops 40 so the head 64 contacts the anchor loops 40 but does not pass through the anchor loop 40. Each spike 38 is therefore nail-shaped, with a shaft diameter typically 0.20 inches and length 8- to 12 inches, depending on soil characteristics. The head 64 can be a circular shape as shown in FIG. 4, or the head 64 may assume another shape so long as it has sufficient size to contact and hold the anchor loop 40 to the ground 36. The frame spike 38 can also assume the shape of a staple or other conventional shape for attaching an object to the ground 36.

The primary function of anchoring the device 30 to the ground 36 is achieved by the frame spikes 38 extending through the anchor loops 40 and into the ground 36. The longitudinal restraint cable or wire 42 provides secondary or additional assurance that the device 30 will not be blown away or moved substantially away from its initial position in the event the frame spikes 38 anchoring the individual frame structures come loose or are dislodged from the ground 36.

As shown in FIGS. 1, 4 and 5, the restraint wire 42 is connected to the frame structures 34 by extension through the anchor loops 40 along with the shaft 62 of the frame spikes 38 before driving the spikes 38 into the ground. Alternatively, the restraint wire 42 can extend within an open center within each D-shaped frame structure 34 along the base portion 54. As an alternative to threading the restraint wire 42 through the anchor loops 40 or extending the restraint wire 42 through the open center of the frame structure 44 the restraint wire 42 may also be connected to the frame structures 34 with the same type of hog-ring connector used to attach the netting sheet 32 to the frame structures 34. A single longitudinal restraint wire 42 can be used to anchor multiple devices 30 aligned in a row.

The restraint wire 42 is connected to the ground 36 by driving the restraint spikes 46 through the restraint loops 44 at the ends of the restraint wire 42. The restraint wire 42 can also be connected to the ground 36 at positions between the restraint loops 44 at its terminal ends, by connecting a connector (not shown) to the restraint wire 42 at an intermediate position between the opposite restraint loops 44, and inserting a restraint spike 46 through that connector.

Connecting the restraint cable to the ground 42 at a middle location between the terminal restraint loops 44 may be particularly useful when a series of the control devices 30 are arranged in a row, as shown in FIG. 5. The devices 30 are positioned end-to-end, with the open end of one device 30 adjoining the open end of another device 30. In this way, a continuous row of devices 30 of any useful length can be obtained. In this circumstance, a single common restraint wire 42 is used to extend between and connect to the ground 36 all of the D-shaped frame structures 34 of all of the control devices 30 in the row. The restraint wire 42 is secured to the ground 36 with the restraint spikes 46 extending through the terminal restraint loops 44, and with any additional intermediate restraint spikes 46 connected to middle locations of the restraint wire 42. The single restraint wire 42 provides secondary anchoring to hold the frame structures 34 of all of the devices 30 in the row to the ground 36. In this manner, singular and multiple windblown particle control devices 30 may be positioned and oriented as desired to achieve the best windblown particle control effect.

The anchoring system created by using the frame spikes 38 extending through the anchor loops 40, and the restraint wire 42 with the restraint spikes 46 extending through restraint loops 46, allows each device 30 and each row of multiple devices 30 to be conveniently removed and stored when the devices 30 are no longer needed after the winter season, for example. Each device 30 and each row of multiple devices 30 can also be conveniently and quickly repositioned, as necessary, to take maximum advantage from changed terrain and from predominant wind directions, among other reasons. In most circumstances, the control devices 30 will be assembled at the site of use by attaching the netting sheet 32 to the frame structures 34 at that location. When not in use, the control devices 30 will be disassembled at the site of use, and the netting sheets 32 and frame structures 34 from the devices 30 will be stored in a state disconnected from one another. By disassembling the control devices 30 in this manner, space is conserved in storing the devices compared to the space consumed by each device in its assembled form.

Figure 6:
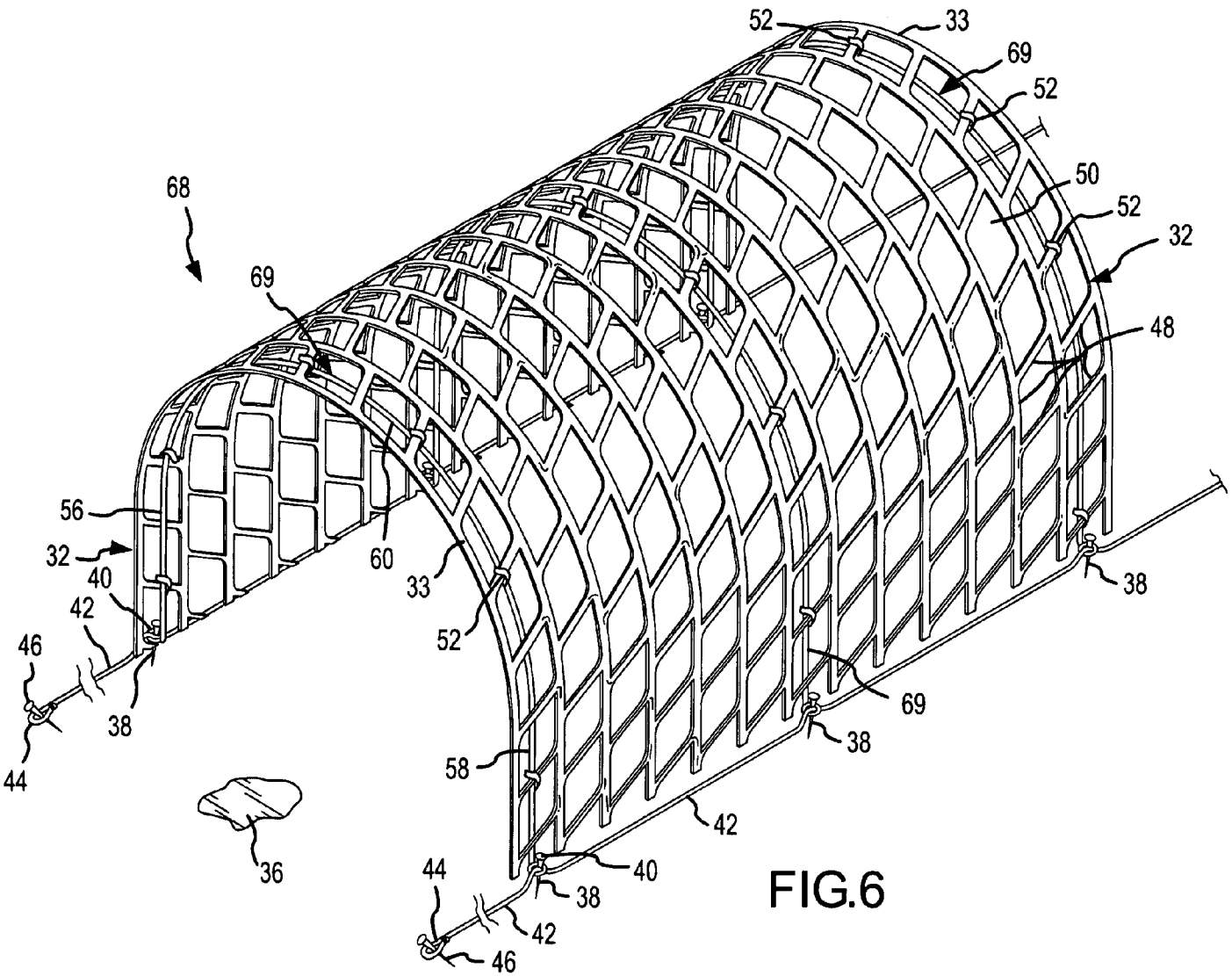
FIG. 6 is a perspective view of another form of a porous tubular windblown particle control device incorporating the present invention.
Figure 7:
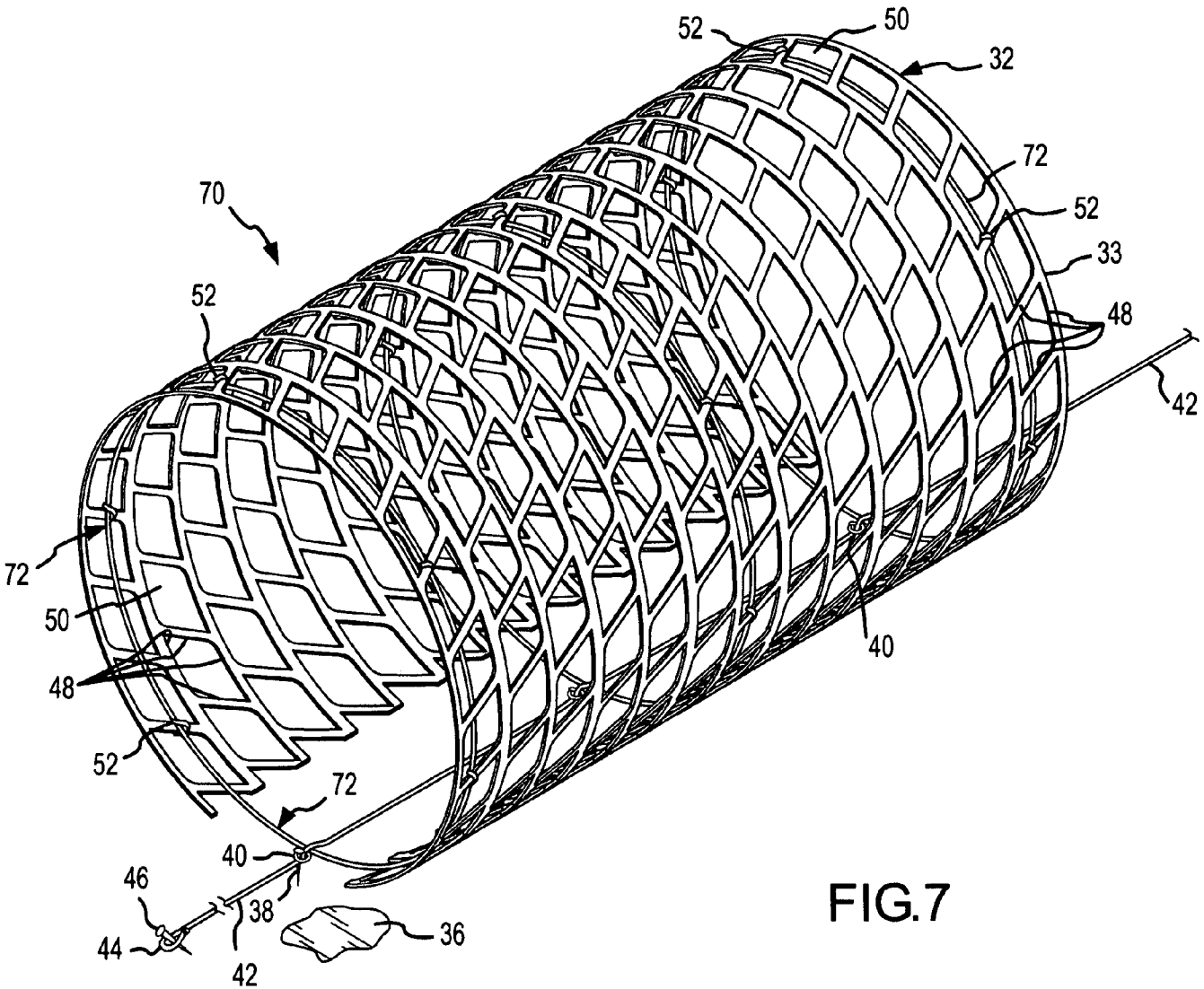
FIG. 7 is a perspective view of still another form of a porous tubular windblown particle control device incorporating the present invention.
Figure 8:
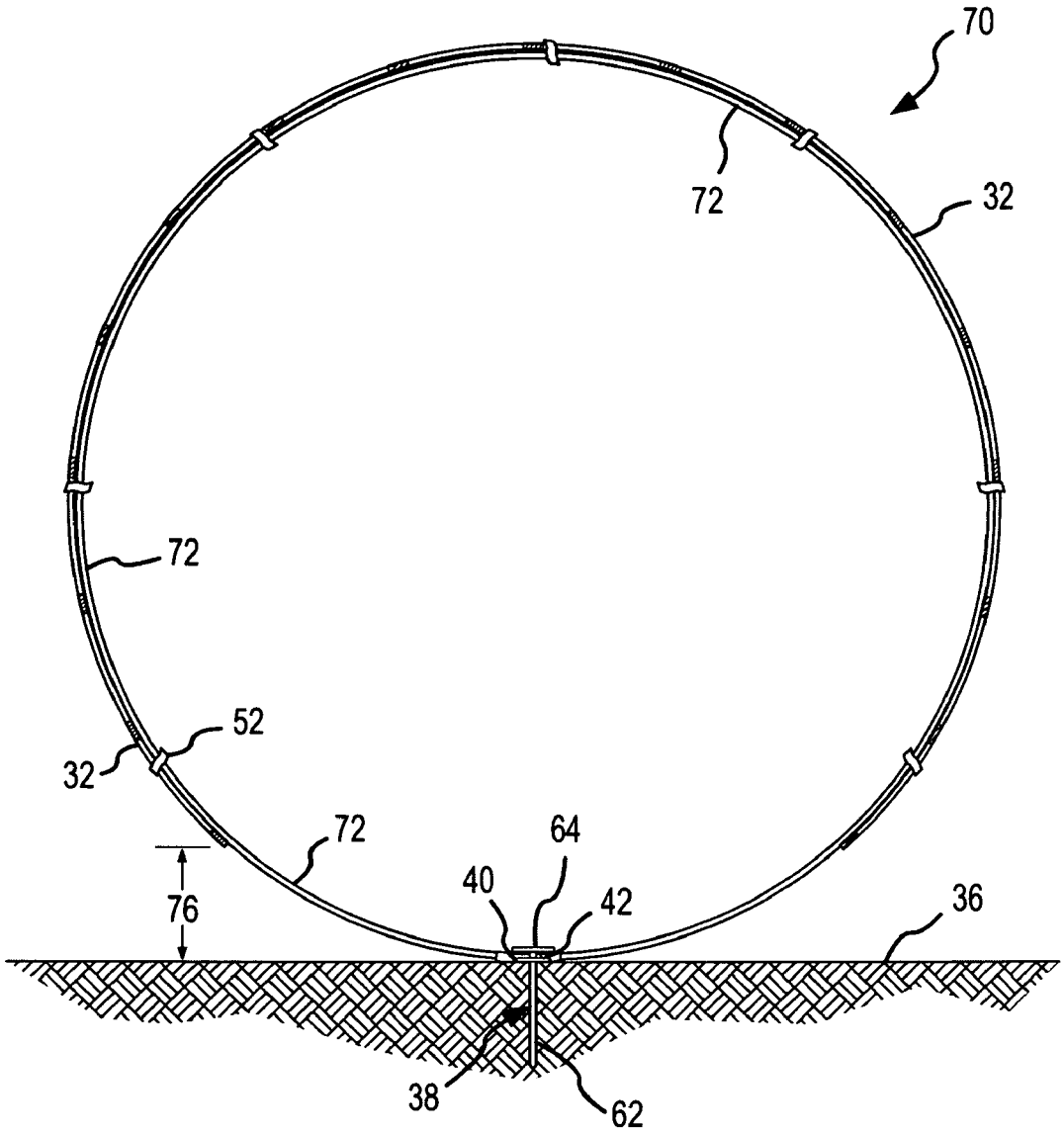
FIG. 8 is an end elevational view of the control device shown in FIG. 7.
Figure 9:
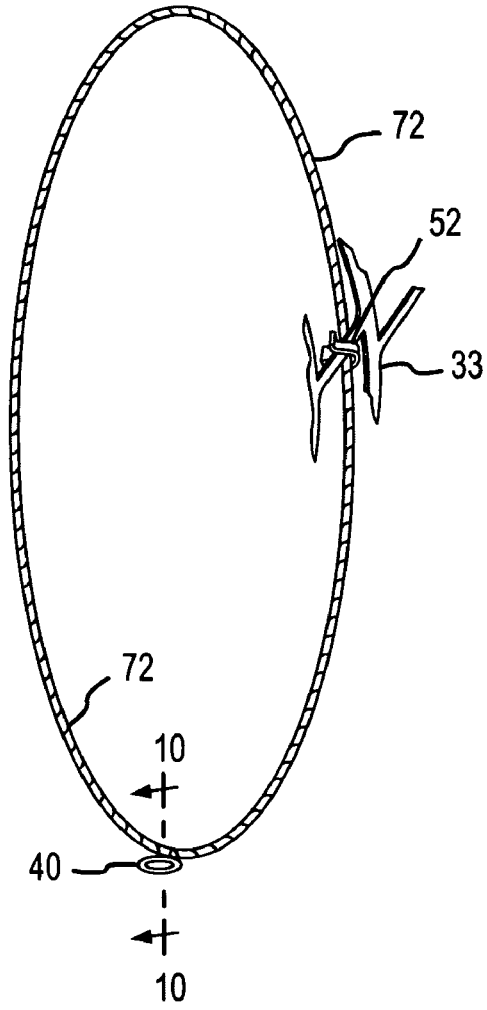
FIG. 9 is a perspective view of a single frame structure of the control device shown in FIG. 7, with a broken away piece of netting material attached.

Another porous tubular windblown control device 68, which also incorporates the present invention is shown in FIG. 6. The control device 68 uses frame structures 69 generally having an outer peripheral shape of an alphabetical letter "U", rather than in a D-shaped configuration. Consequently, the base portion 54 (FIGS. 1, 3 and 4) is eliminated from each frame structure 69. The anchor loops 40 are formed by twisting and overlapping an end portion of the leg portions 56 and 58 of the U-shaped frame structure 69. Connecting the anchor loops 40 to the ground 36 by the frame spikes 38 establishes adequate transverse support between the opposite leg portions 56 and 58 for the U-shaped frame structures 69, without the base portion 54 of the D-shaped frame structures 34 (FIG. 1), because the retention of the anchor loops 40 to the ground 36 establishes almost as much structural integrity for the U-shaped frame structure 69 as the base portion 54 establishes for the D-shaped frame structures 34. Connecting the U-shaped frame structures 69 to the ground also establishes the tubular configuration and also establishes an open center through the U-shaped frame structures.

The porous tubular windblown control device 68 with the U-shaped frame structures 69 is used in essentially the same described manner as the control device 30 with the D-shaped frame structure (FIG. 1), and the control device 68 performs in essentially the same manner as the control device 30. However, the advantage of the control device 68 is that it may be preassembled away from the site of its use and shipped economically to the use location in assembled form. Multiple control devices 68 using U-shaped frame structures 69 can be stacked or nested on top of one another and shipped without consuming excessive space. The bottom opening of the control devices 68 allows the U-shaped frame structures 69 to be stacked on top of one another with the rounded half-cylinder top portion of the lower control device 68 receiving the U-shaped frame structures 69 of an upper control device 68. Nesting the preassembled control devices 68 in this manner makes it economical to ship them in preassembled form, because each control device does not consume excessive space. Similarly, control devices with U-shaped frame structures can also be stored during time periods when they are not used by stacking the assembled devices in the same manner. It is not necessary to disassemble the control devices 68 to obtain the advantage of compact and space-efficient storage.

Another porous tubular windblown particle control device 70 which also incorporates the present invention is shown in FIGS. 7~11. The control device 70 is similar to the control devices 30 and 68 (FIGS. 1–5 and 6), except that it employs a plurality of longitudinally spaced-apart frame structures 72 each having an outer peripheral shape of an alphabetical letter "O", rather than the D-shaped frame structure 34 of the device 30 or the U-shaped frame structure 69 of the device 68. The sheet 32 of the extruded plastic netting material 33 is attached to the O-shaped frame structures 72 with the netting connectors 52. Anchor loops 40 are attached to the O-shaped frame structures 72 to receive the frame spikes 38 and the longitudinal restraint wire 42, to anchor the control device 70 to the ground 36.

Each O-shaped frame structure 72 is preferably formed from a length of wire that is bent into a circular shape with its ends welded together to create an integral circular shaped structure having an open center. The circular configuration of the O-shaped frame structures 72 must support the entire weight of the netting sheet 32 and the frame structures 72 above a relatively short segment of the O-shaped frame structures 72 in contact with the ground 36. There are no vertical components immediately in contact with the ground, such as the leg portions 56 and 58 of the control device 30 (FIG. 4), to transfer the weight vertically downward into the ground 36, so the entire weight of the netting sheet 32 and the frame structures 72 must therefore be transferred vertically downward into the ground through the relative rigidity of the integral O-shaped frame structures 72. Because of the relative ease of vertical flexibility across the diameter of the O-shaped frame structures 72, the material from which the O-shaped frame structures 72 are formed must have sufficient rigidity to support the entire weight of the control devices 70 without sagging substantially. For these reasons, the wire from which the O-shaped frame structures 72 are preferably made is galvanized, spring steel wire that provides sufficient rigidity diametrically to sustain the weight of snow that may accumulate on top of the control device 70, and to withstand the lateral wind loading forces applied to the control device 70 during use. Of course, if a non-spring steel wire has sufficient strength and rigidity characteristics, or if other types of metallic and nonmetallic materials exhibit sufficient strength, they may also be used to form the O-shaped frame structures 72.

The anchor loops 40 are welded or otherwise fused to the wire at the lowermost location of the O-shaped frame structures 72, where the lower segments of the O-shaped frame structures 72 contact the ground 36. If the O-shaped frame structures are formed of wire capable of being bent at a short radius without losing its strength, anchor loops can be bent in the O-shaped frame structures 72 in the same overlapping twisted manner as described in conjunction with FIG. 4. Locating the anchor loops 40 at the lowermost position places them adjacent to the ground 36 to receive the frame spikes 38.

Figure 10:
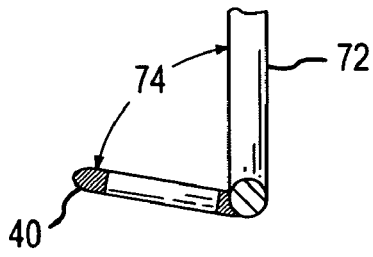
FIG. 10 is an enlarged section view of an anchoring device attached to the frame structure shown in FIG. 9, taken substantially in the plane of line 10—10 of FIG. 9.
Figure 11:
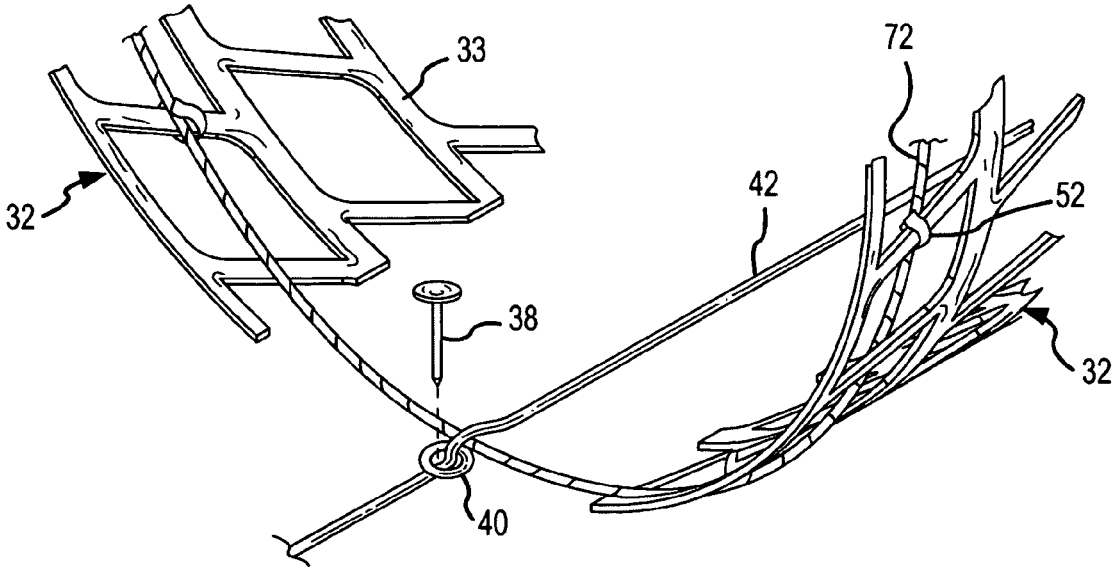
FIG. 11 is a perspective view of a lower portion of the control device shown in FIG. 7, illustrating aspects of an anchoring system for the control device.

The anchor loop 40, shown in FIG. 10, extends at an obtuse angle 74 to a plane defined by the O-shaped frame structure 72. The obtuse angle 74 of the anchor loops facilitates extending the restraint wire 42 through the anchor loops 74 while allowing the O-shaped frame structures 72 to remain generally perpendicular to the surface of the ground 36, as shown in FIG. 11. The restraint wire 42 passes over the top of the O-shaped frame structures 72, inside of the O-shaped frame structure 72 where it contacts the ground, and passes through the anchor loop 40 as shown in FIG. 11. The longitudinal restraint wire 42 contacts and presses down on the frame structures 72. The frame spikes 38 extend through the anchor loops 40 along with the restraint wire 42 to secure the frame structure 72 to the ground 36.

The netting sheet 32 extends around the circumference of the O-shaped frame structures 72 to the extent that the sheet 32 terminates a short distance 76 (FIG. 8) above the ground 36. The portions of the O-shaped frame structures 72 that are closest to the ground 36 are therefore not covered by the netting sheet 32. Terminating the netting sheet before contacting the ground facilitates placing the restraint wire 42 through the anchor loops 40 and reduces the size of the netting sheet 32. However, terminating the netting sheet 32 a slight distance above the ground 36 does not diminish the effectiveness of the device 70 in controlling windblown particles, because the snow or other windblown particles accumulate on the ground in this area and the wind at this relatively low level is not usually significant in carrying or transferring a substantial number of windblown particles from that location. After the amount of snow or other windblown particle accumulates to the height 76 (FIG. 8), the netting sheet 32 fully confronts the wind. Terminating the netting sheet 32 at the slight distance 76 above the ground does not diminish the overall cylindrical tubular configuration of the control device 70.

Another porous tubular windblown particle control device 80 which also exhibits a cylindrical tubular configuration and which incorporates the present invention is shown in FIGS. 12–16. The control device 80 uses O-shaped frame structures 82 to which the sheet 32 of extruded plastic netting material 33 is attached. However, the control device 80 differs from the control device 70 in that no separate netting connectors 52 are used to connect the netting sheet 32 to the O-shaped frame structures 82, the netting sheet 32 extends completely around the O-shaped frame structures 82 rather than terminating at the short distance 74 above the ground 36 (FIG. 8), and no anchoring loops 40 are attached to the O-shaped frame structures 82.

The netting sheet 32 is secured to the O-shaped frame structures 82 by weaving the wire which forms the O-shaped frame structures 82 circumferentially through the apertures 50 in the netting sheet 32 on alternating sides of the webs 48, as shown in FIGS. 12–15. In this manner the wire which forms the O-shaped frame structures 82 is firmly connected within the netting sheet 32, and woven interaction of the wire of the frame structures 82 with the apertures forms interactive netting connectors rather than separate netting connectors 52. Weaving the wires of the O-shaped frame structures 82 through the apertures 50 in this manner also eliminates the expense and time required to use separate netting connectors 52, virtually eliminates the possibility of the netting sheet 32 separating from the frame structures due to failures of the separate netting connectors 52, and allows a quick and convenient way to disassemble the control device 80, among other advantages.

Figure 14:
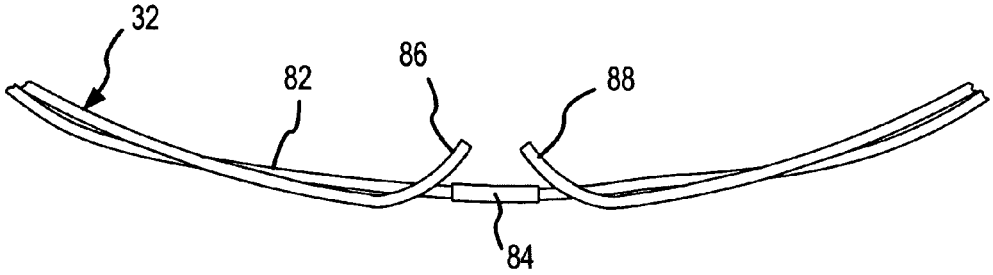
FIG. 14 is an enlarged end elevational view of a portion of FIG. 13, illustrating aspects of a frame structure of the control device shown in FIG. 12.
Figure 15:
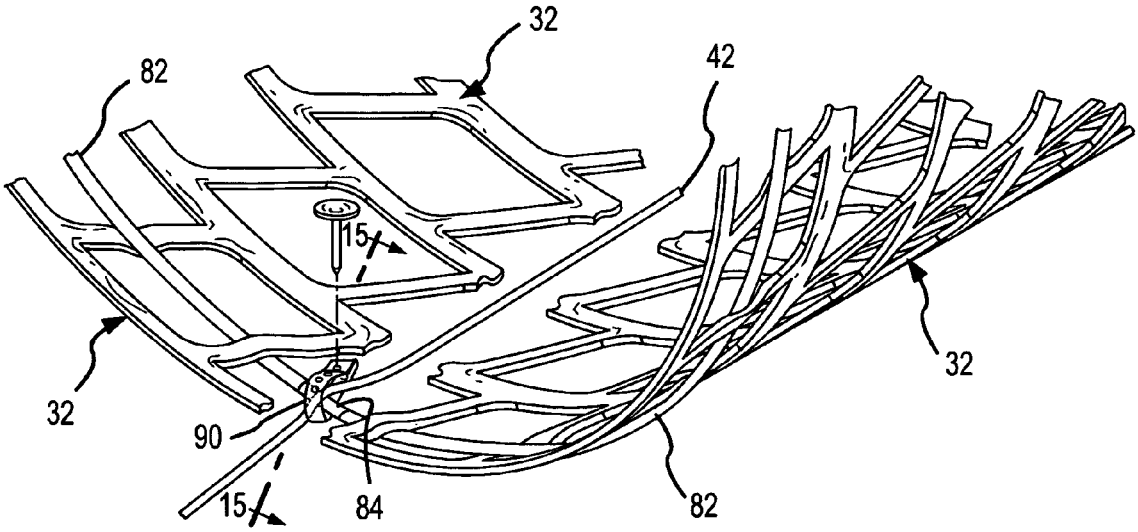
FIG. 15 is an enlarged perspective view of a lower portion of the control device shown in FIG. 12, illustrating aspects of an anchoring system for the control device.
Figure 16:
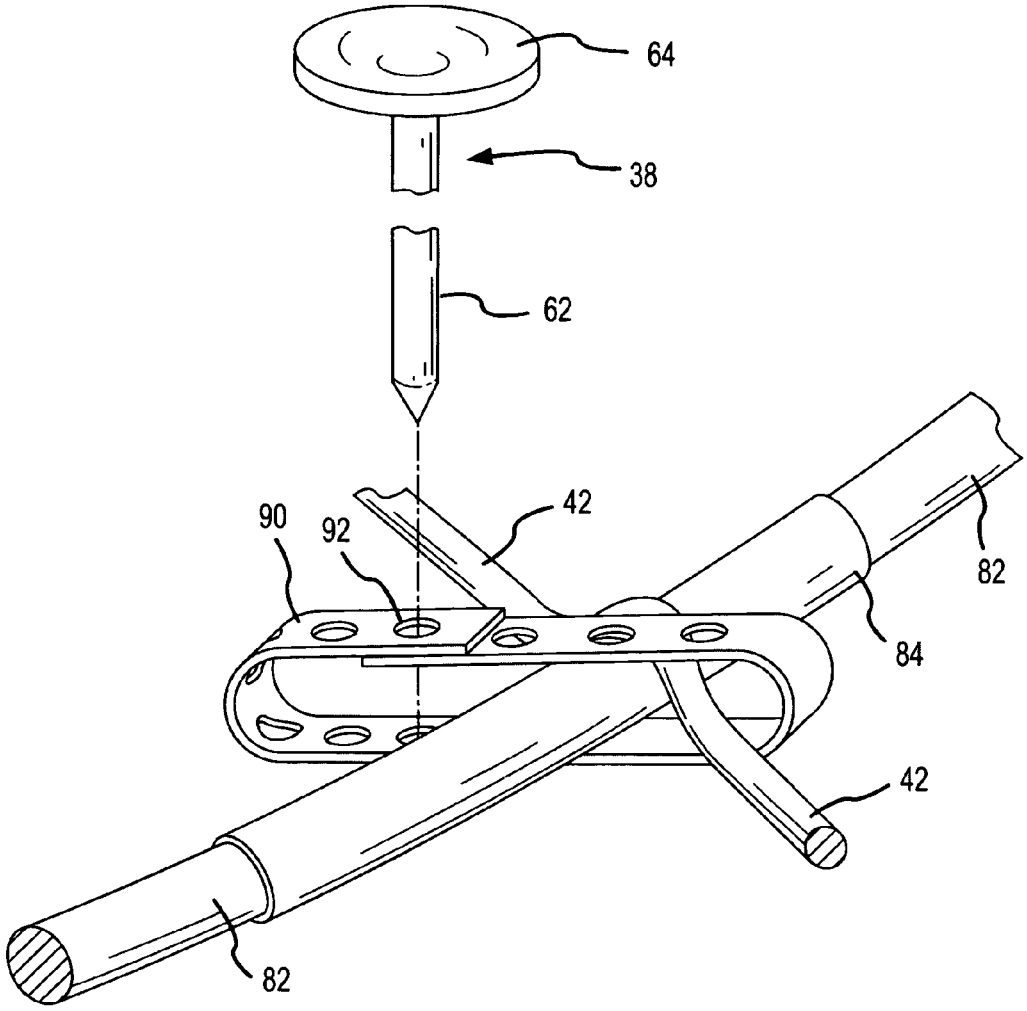
FIG. 16 is an enlarged perspective view of a portion of FIG. 15.

To weave the wire of the O-shaped frame structures 82 through the apertures 80 requires that the O-shaped frame structure 82 not be permanently formed in a continuous circular shape. Instead, it is necessary that ends of the O-shaped frame structure 82 have the capability to separate at a position so that one exposed end is available to thread through the apertures 50. A coupling or ferrule 84 is used to attach the ends of the wire which forms the O-shaped frame structure 82, as shown in FIGS. 14 and 16. The ferrule 84 is a tubular body which receives at its opposite ends, the opposite ends of the wire which forms one O-shaped frame structure 82. The ferrule 84 holds together the opposite ends of the wire which forms the O-shaped frame structure to complete the circular shape of the frame structure 82. Disconnecting one of the ends at the ferrule 84 allows that disconnected end to be woven through the apertures 50 of the sheet 32. The ferrule 84 is preferably permanently attached to one of the ends of the wire which forms the O-shaped frame structure 82 by crimping or welding, while the other end of the wire which forms the O-shaped frame structure is retained by friction within the other end of the ferrule 84.

Figure 12:
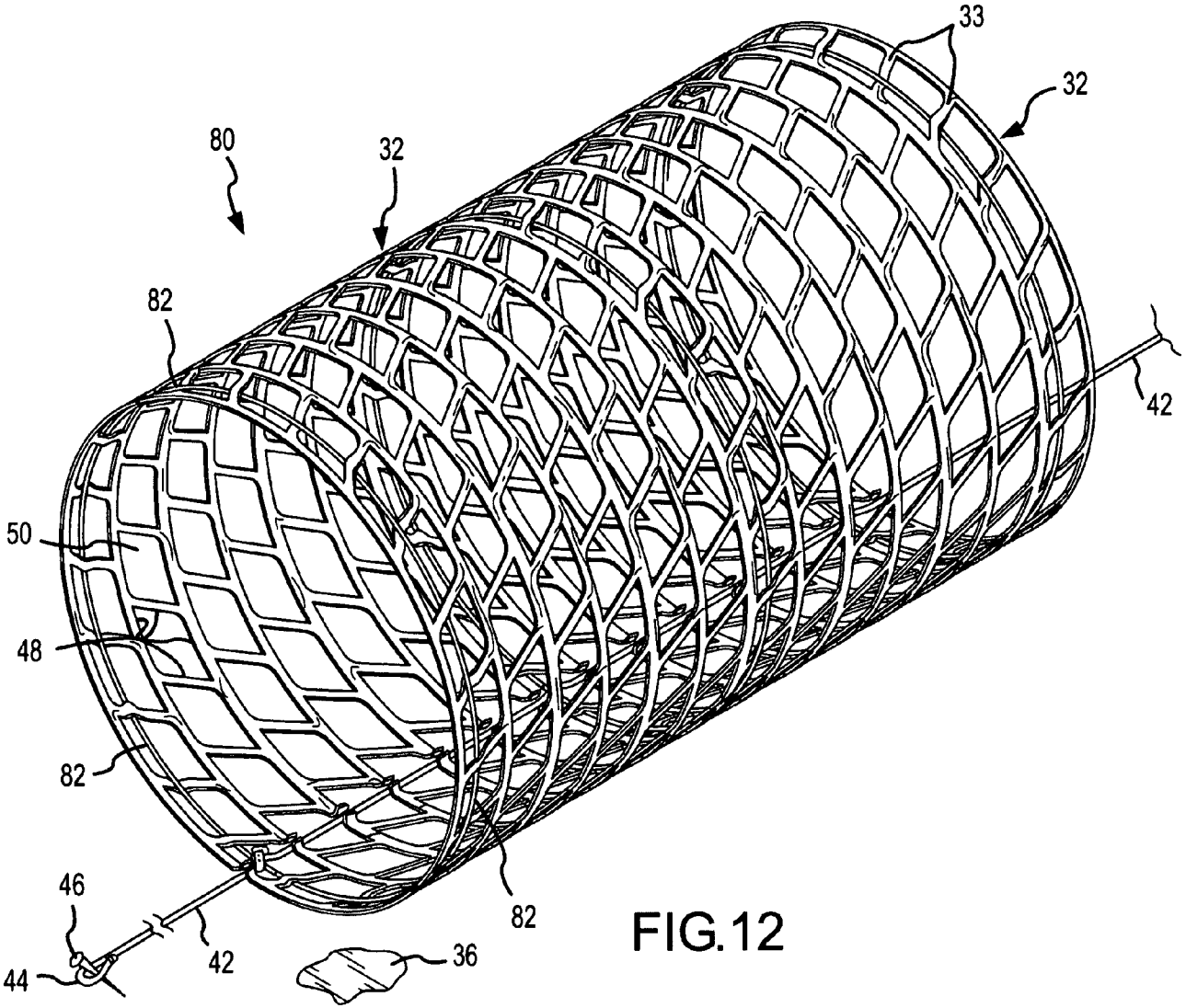
FIG. 12 is an enlarged perspective view of another form of a porous tubular windblown particle control device incorporating the present invention.
Figure 13:
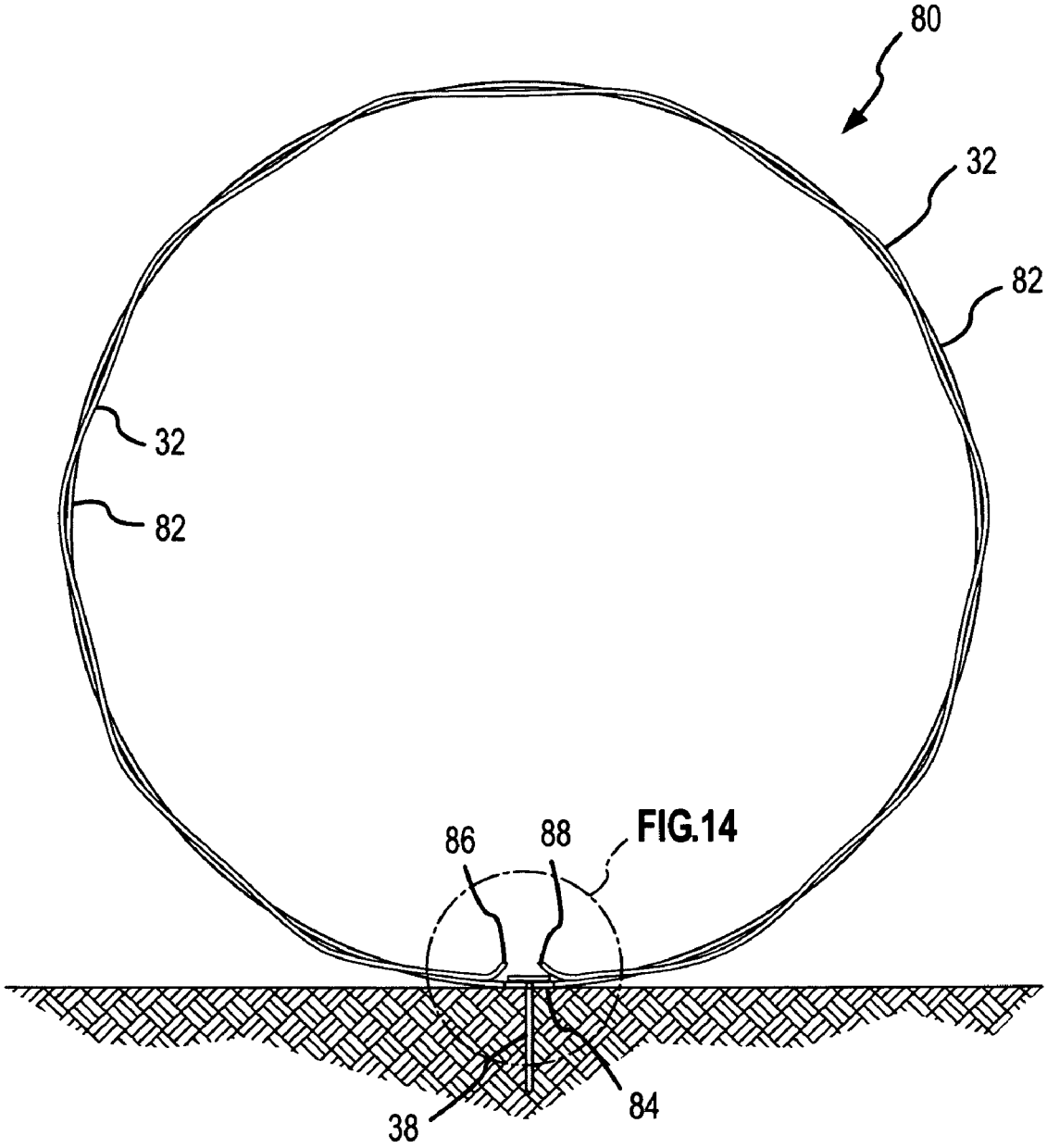
FIG. 13 is an end elevational view of the control device shown in FIG. 12.

The circumferential length of the wire which forms each O-shaped frame structure 82 may be slightly less in length than the circumferential distance around the netting sheet 32. In such circumstances, opposite longitudinal edges 86 and 88 of the netting sheet 32 may overlap somewhat in the location of the ferrule 84, as shown in FIGS. 12, 13 and 14. However, an overlap of the longitudinal edges 86 and 88 is not required. The longitudinal edges 86 and 88 may touch each other, or may be separated by a relatively short gap, or may be separated by a relatively greater distance to space the longitudinal edges above the ground, such as by the distance 74 illustrated in FIG. 8.

The anchor system for the control device 80 also uses anchor straps 90 to retain the O-shaped frame structures 82 to the ground 36. The anchor strap 90 has a series of holes 92 formed at spaced apart locations along its length, and each of the holes 92 has a diameter large enough to receive the shaft 62 of one frame spikes 38, as shown in FIG. 16. The anchor strap 90 is looped around the O-shaped frame structure 82 and the longitudinal restraint wire 42 and ends of the anchor strap 90 are overlapped. The shaft 62 of the frame spike 38 is extended through two aligned holes in the overlapping ends of the anchor strap 90 and through one additional hole in the middle portion of the anchor strap 90. The shaft 62 of the frame spike 38 is driven into the ground 36 until the head 64 of the frame spike contacts the anchor strap 90. In this manner, the O-shaped frame structure 82 and the restraint wire 42 are secured to one another and to the ground 36, thereby securing the control device 80 to the ground 36. Although it is not necessary to attach the O-shaped frame structures 82 to the ground 36 with the ferrule 84 contacting the ground, this is typically the position of the ferrule 84 because threading the wire of the O-shaped frame structures 82 through the apertures 50 of the netting usually results in positioning the ferrule 84 close to one of the longitudinal edges 86 or 88 of the netting sheet 32.

Use of the anchor strap 90 in the manner described allows the control device 80 to be secured relatively easily and conveniently to the ground 36. Similarly, the anchor strap 90 allows the control device 80 to be taken up from the ground 36 in an equally convenient manner, and thereafter disassembled or positioned as desired.

The tubular porous windblown particle control devices which incorporate the present invention may be positioned in various arrays and configurations to achieve the desired type and degree of control over windblown particles. As previously noted, the predominant use of the windblown particle control devices is controlling blowing snow. Typically, the control devices will be used to prevent snow from accumulating to the degree where it blocks vehicular traffic and to prevent snow from sifting onto the roadways, melting there, and then refreezing into ice. The control devices can also be used in a similar manner for railroad applications to prevent snow from forming drifts in cuts through hills, clogging switches and interfering with electronic detectors. Other uses of the control devices may be to retain snow on disturbed lands so as to increase soil moisture to facilitate revegetation, retain snow on agricultural lands to increase crop yields, or to increase snow available for recreational use such as on skiing trails. The snow accumulation and control capability of each control device will generally extend horizontally along the ground for a distance of approximately thirty to forty times the height of the control device. The control devices can also be used to reduce wind erosion of soil from agricultural lands, topsoil storage piles, sources of fugitive dust associated with mining or road construction, and sources of blowing sand on beaches and desert areas. Many other uses of the control devices are known and will be apparent.

Since the dominant application for the windblown particle control devices is controlling snow over the roadways, examples of positioning the control devices relative to roadways are shown in FIGS. 17–21, where the porous tubular windblown particle control devices are generally referenced 100. The reference number 100 is intended to refer to any form of the porous tubular windblown particle devices described herein and in accordance with the present invention. The control devices 100 may be arranged in various configurations with respect to a divided highway having one roadway 102 carrying traffic in one direction and another roadway 104 carrying traffic in the opposite direction. The control devices 100 are arranged in arrays and configurations to take advantage of changes in elevation of the terrain adjacent to the roadways 102 and 104, and to take advantage of the prevailing wind direction.

Figure 17:
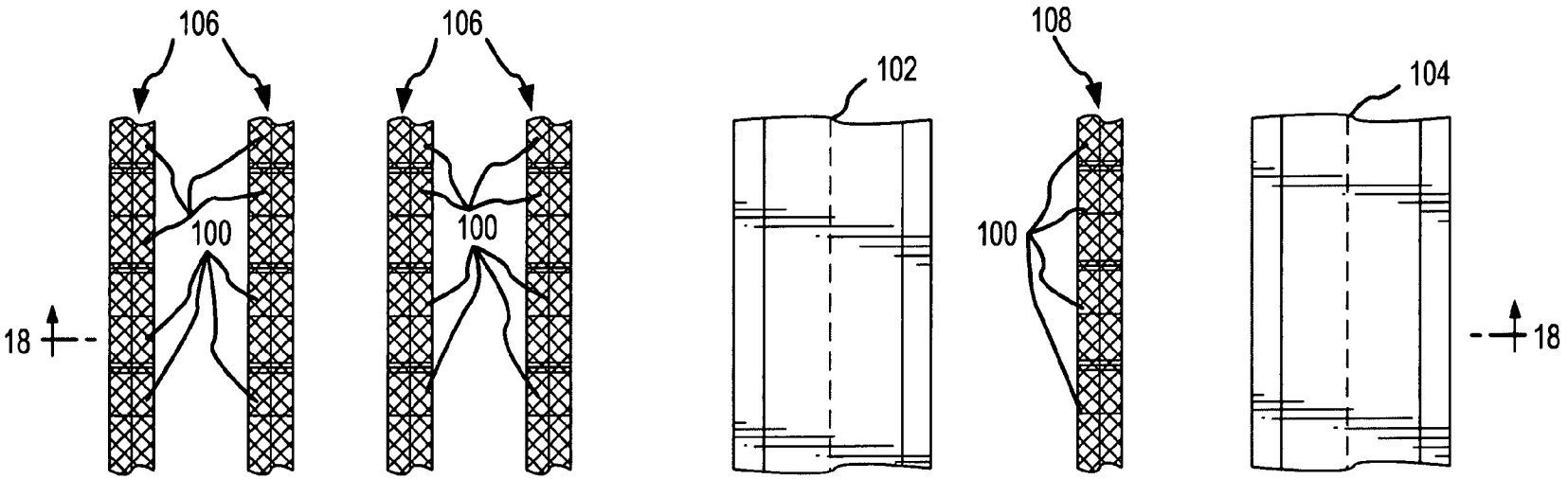
FIG. 17 is a top plan view of multiple porous tubular windblown particle control devices of the type shown in FIGS. 1, 6, 7, 12, or otherwise in accordance with the present invention, arranged in rows positioned relative to a multiple lane roadway.
Figure 18:
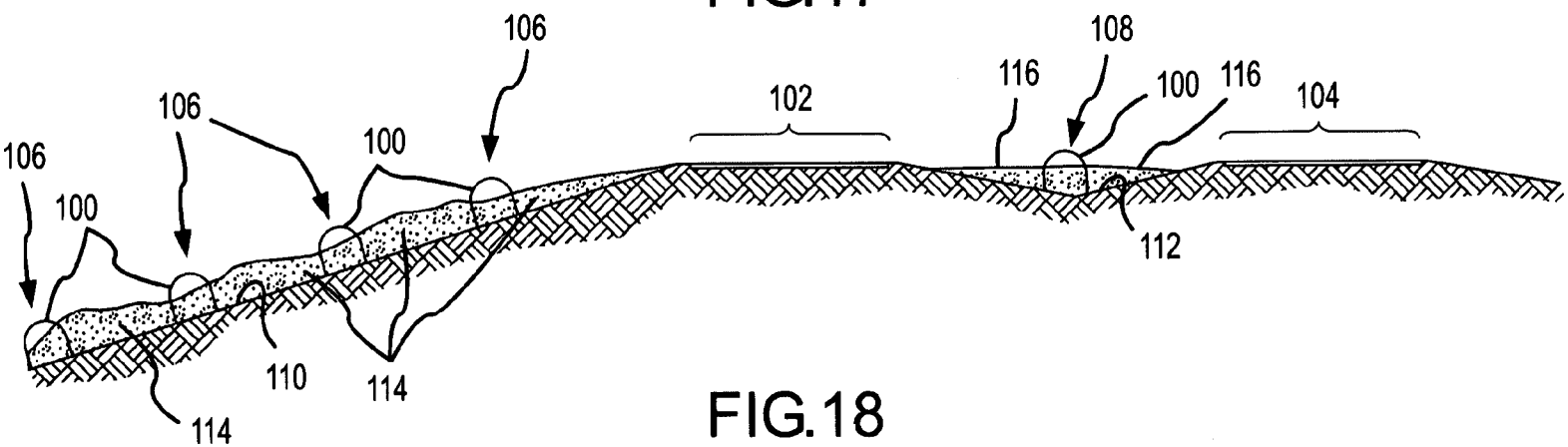
FIG. 18 is a vertical cross-sectional view of FIG. 17, taken substantially in the plane of line 18—18.

The control devices 100 shown in FIGS. 17 and 18 are arranged in linear rows 106 and 108 extending generally parallel to the roadways 102 and 104. The rows 106 of devices 100 are positioned on the left-hand side of the roadway 102, and a single row 108 of devices 100 is positioned on the right-hand side of the roadway 102, as shown in FIGS. 17 and 18, to take advantage of a left-to-right (as shown) prevailing wind direction. The rows 106 of devices 100 are also positioned on an upward sloping grade 110 adjacent to the roadway 102. The linear row 108 of devices 100 is positioned in a ditch 112 between the roadways 102 and 104.

The snow effect available from the control devices 100 arranged in this manner is generally illustrated in FIG. 18. The rows 106 of control devices 100 on the upwind side of the roadway 102 on upward sloping grade 110 capture and remove a significant amount of the snow from the wind before the wind blows over the roadway 102. The captured and removed snow is deposited and maintained in banks 114 predominantly on the downwind sides (right as shown in FIG. 18) of the rows 106 of control devices 100. By depositing and maintaining the snow in the banks 114, the snow does not accumulate on the roadway 102. The transition from the upward sloping grade 110 to the horizontal roadway 102 would normally cause the snow to settle from the wind directly on the roadway 102, but the rows 106 of control devices 100 have removed a significant portion of the snow in the wind by the time that the wind passes over the roadway 102. The velocity-reducing and turbulence effects of the rows 106 of control devices 100 also has the effect of maintaining the snow in the banks 114 thereby preventing the snow from sifting in significant amounts onto the roadway 102 where the snow may melt because of the thermal capacity of the roadway 102 and then refreeze into a coating of ice over the roadway 102.

The single row 108 of control devices 100 in the median ditch 112 helps to stabilize the snowcover in the median, and also causes deposition of the residual snow which may pass over the roadway 102, and deposits and maintains that captured snow in banks 116 between the roadways 102 and 104. The row 108 of control devices 100 maintains the captured snow in the banks 116 and prevents the snow from sifting onto the roadway 104 where it might melt and thereafter freeze as ice over the roadway 104. The depression caused by the ditch 112 would normally have the effect of accumulating snow which would thereafter continuously drift onto the roadway 104, were it not for the presence of the row 108 of control devices 100.

Figure 19:
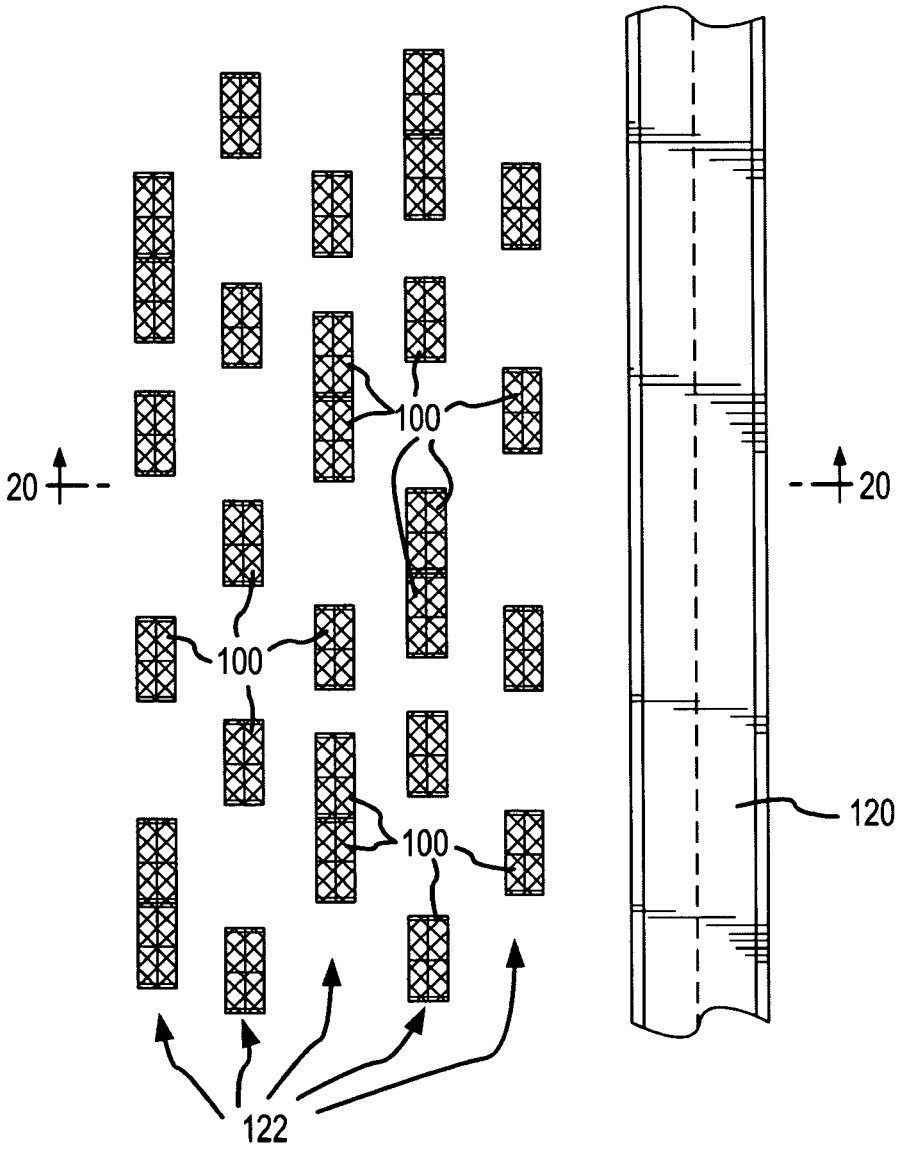
FIG. 19 is a top plan view of multiple porous tubular windblown particle control devices of the type shown in FIGS. 1, 6, 7, 12, or otherwise in accordance with the present invention, arranged in discontinuous rows and positioned on one side of a single lane roadway.
Figure 20:
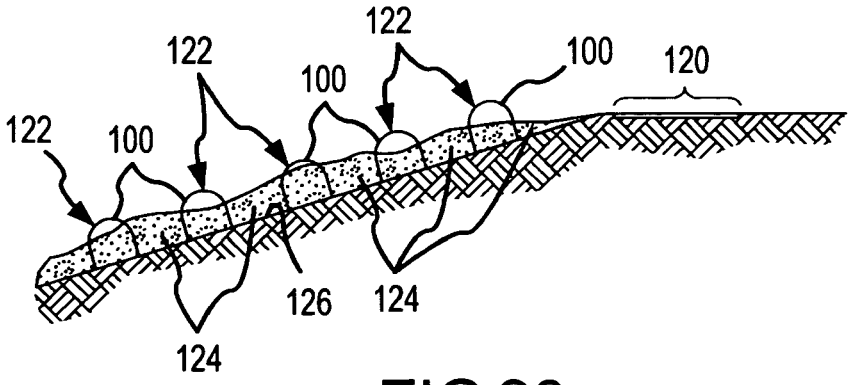
FIG. 20 is a vertical cross-sectional view of FIG. 19, taken substantially in the plane of line 20—20.

Another arrangement of control devices 100 relative to a roadway 120 is shown in FIGS. 19 and 20. The configuration of control devices 100 shown in FIGS. 19 and 20 is similar to the configuration of control devices 100 on the left-hand side (as shown) of the roadway 102 shown in FIGS. 17 and 18, except that the rows 122 of control devices 100 are discontinuous. Gaps exist between adjacent ones of the control devices 100 in each of the rows 122, shown in FIGS. 19 and 20. The placement of the control devices 100 in the discontinuous rows 122, the numbers of control devices 100 positioned end-to-end, and the lengths of the gaps between adjacent ones of the control devices 100 in each of the rows 122, are factors which are selected and determined according to the specific terrain, the specific prevailing wind direction, the specific desired snow deposition and stabilization conditions, and other specific conditions. Depending on the specific use conditions, placing the control devices 100 in the discontinuous rows 122 may achieve just as adequate snow control over a particular section of the roadway 120 as if continuous rows of the control devices 100 (FIGS. 17 and 18) were used.

Even with the gaps in control devices 100, the control devices 100 are nevertheless effective in controlling windblown snow to prevent the snow from blocking the roadway 120, and from sifting onto the roadway 120, melting and then refreezing to form a sheet of ice on the roadway. Instead, as shown in FIG. 20, the snow is deposited in banks 124 primarily on the downwind side of the control devices 100 positioned in the discontinuous rows 122 on an upward-sloping grade 126 leading to the roadway 120, in much the same manner as has been previously discussed in conjunction with continuous rows 106 of control devices 100 shown in FIGS. 17 and 18. Positioning the control devices 100 in the discontinuous rows may reduce the overall number of control devices 100 needed to control the blowing snow over a particular segment of a roadway 120, thereby reducing the cost of controlling the blowing snow over that segment of the roadway.

Figure 21:
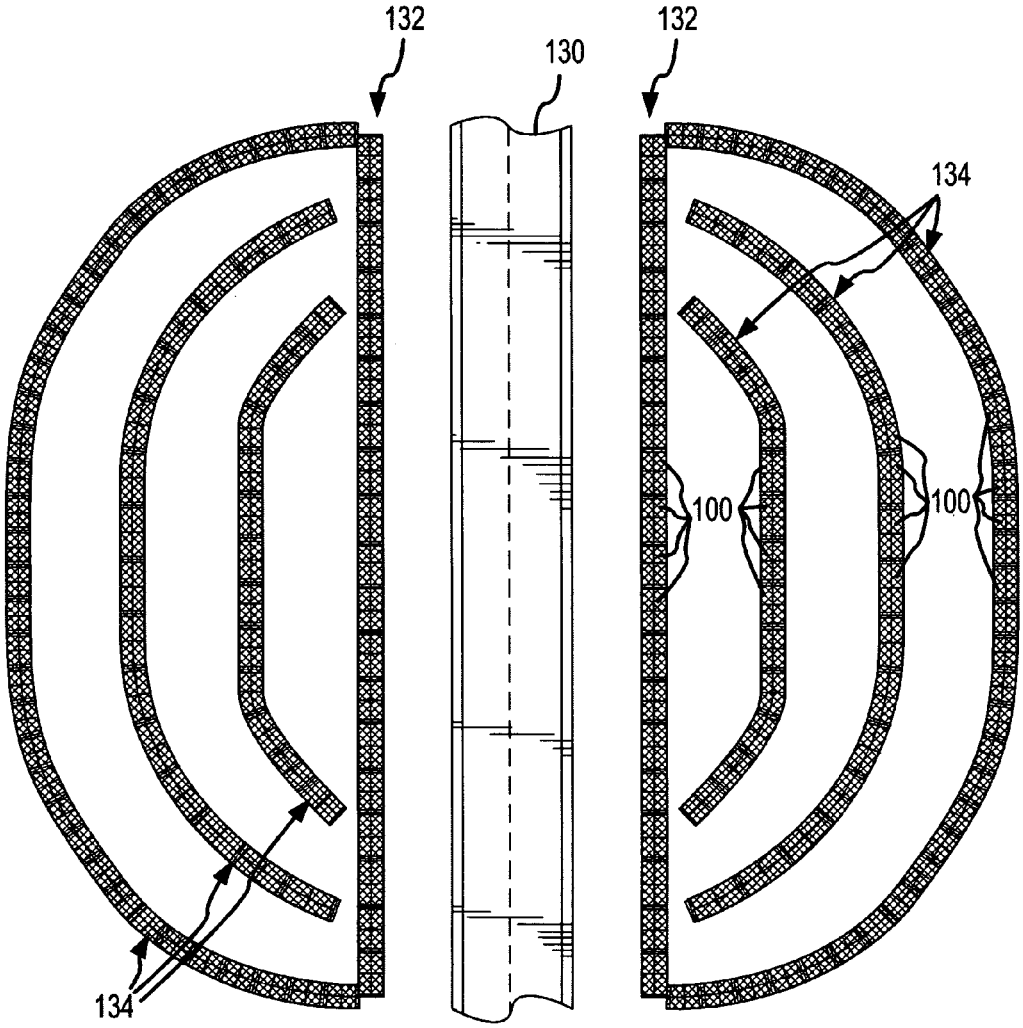
FIG. 21 is a top plan view of multiple porous tubular windblown particle control devices of the type shown in FIGS. 1, 6, 7, 12, or otherwise in accordance with the present invention, arranged in an array having linear and curved rows positioned on both sides of a single lane roadway.

Another array or configuration of the control devices 100 relative to a roadway 130 is shown in FIG. 21. The control devices 100 are arranged in linear rows 132 on both sides of the roadway 130, and in curved rows 134 on both sides of the roadway. Although not shown in FIG. 21, the linear and curved rows 132 and 134 could also be discontinuous as illustrated in FIGS. 19 and 20. Using the curved rows 134 has the advantage of obtaining maximum control over the blowing snow from a wide variety of wind directions, including wind directions which are almost parallel to the roadway 130. Using the linear row 132 adjacent to the roadway 130 provides the maximum snow control effect immediately adjacent to the roadway 130. Positioning a similar configuration of control devices 100 on both sides of the roadway 130 is beneficial when there is no prevailing or predominant wind direction with respect to a particular segment of roadway 130.

Positioning the control devices 100 adjacent to a roadway does not create a substantial obstruction to errant vehicles that might leave the roadway and collide with the control devices 100. The control devices 100 are not structurally bulky or substantial, and will deform or crush upon impact without significantly damaging the vehicle. The ability to deform or crush without damaging a vehicle is unlike most snow fences which are made from rigid bulky materials, or that are installed on steel posts that would seriously damage a vehicle in a collision. The control devices 100 are secured to the ground with the spikes 38 and 46 and the restraint wire 42, all of which are capable of shifting with the impact of a vehicle against the control devices 100. Since the control devices 100 do not create significant traffic obstacles, they can be positioned relatively close to the roadways. The control devices 100 can also quickly and safely slow an errant vehicle and thereby reduce the risk of injury to passengers within the vehicle, especially when partially or completely filled with snow. Control devices 100 placed between divided highway lanes can also prevent or inhibit an errant vehicle from crossing into oncoming traffic on divided roadways, especially when snow has accumulated in and around the control devices 100. Indeed, this application alone constitutes an important safety improvement on divided highways with narrow medians, a shallow ditch and sparse vegetation.

One of the benefits of the windblown particle control device of the present invention is that its tubular configuration always presents two vertically extending components of the sheet 32 of netting material 33 to confront the wind. The two vertically extending components of the netting sheet result because of the two opposite sides of the tubular configuration. The two separated vertical components of netting material interact with one another to jointly contribute aerodynamic drag and turbulence altering effects, thereby enhancing the windblown particle control effects. Presenting the two vertically extending components of the netting material also makes the windblown particle deposition and maintenance effects significantly independent of the direction of the wind, because the porosity and interaction of the two vertically extending components is similar over a relatively wide range of wind direction angles. A tangent to the curved surface in the transverse direction becomes increasingly horizontal with increasing height above the surface. This has the effect of decreasing the aerodynamic porosity of the material in the horizontal direction of the airflow. This vertically non-uniform horizontal porosity effect of the control devices reduces the wind speed to an even greater extent than would be the case with two parallel sheets of netting.

In addition to the advantages of controlling the retention and deposition of snow and other windblown particles, each of the control devices can be constructed relatively inexpensively out of common materials. The cost of manufacturing the control devices is significantly less than the construction costs of many other types of snow fences. The construction of the control devices allows them to be conveniently assembled at the location of use, and disassembled when not in use. The anchoring system for the control devices is formed from relatively lightweight and common materials which can be easily transported to the location of use, and removed after the control devices are removed and/or disassembled. Some forms of the control devices may be assembled away from the location of use and transported to the location of use, because of the ability to stack or nest the control devices relative to one another. When not in use, these types of control devices can be stored in a space-efficient compact manner because of their stacking or nesting capability. In all forms of control devices, disassembly into the component parts allows the component parts to be stored in a space efficient manner. Because of the relative simplicity of the control devices, it is relatively easy and time efficient to assemble and disassemble the control devices. Many other advantages and improvements will be apparent upon fully understanding the significance and aspects of the present invention.

Presently preferred embodiments of the invention and many of its improvements and benefits have been described with a degree of particularity. This description is of preferred examples of implementing the invention, and is not necessarily intended to limit the scope of the invention. The scope of the invention is defined by the following claims.

What is claimed is:

1. A porous tubular windblown particle control device for attachment to a surface of the earth to stabilize particle cover and to control deposition and retention of windblown particles, comprising:

a sheet of netting material formed from a plurality of webs linked together to define apertures between the webs and through the sheet, the netting sheet having a longitudinal dimension and a transverse dimension;

a plurality of frame structures, each frame structure including at least one anchor element to connect the frame structure to the earth surface, each frame structure defining a closed geometric configuration having an open center with horizontal and vertical dimensions across the open center and an outer peripheral shape circumscribing the open center; and netting connectors connecting the sheet of netting material to the plurality of frame structures with the plurality of frame structures positioned in a longitudinally spaced apart relationship along the longitudinal dimension of the sheet of netting material and with the outer peripheral shape of each frame structure extending in the transverse dimension of the sheet of netting material; and the sheet of netting material assuming a generally tubular cross-sectional shape generally corresponding to the outer peripheral shape of the plurality of frame structures when connected to the frame structures;

the transverse dimension of the sheet of netting material is sufficient to extend the sheet of netting material over a substantial majority of the outer peripheral shape of the frame structures to a location adjacent the earth surface; and the sheet of netting material has sufficient inherent strength in the longitudinal dimension to maintain substantially the same generally tubular cross-sectional shape between the longitudinally spaced apart frame structures upon connecting the frame structures to the earth surface at the anchor elements.

2. A windblown particle control device as defined in claim 1, wherein:

the inherent strength of the sheet of netting material is sufficient to maintain the same generally tubular cross-sectional shape between the longitudinally spaced apart frame structures without additional longitudinal reinforcement between the longitudinally spaced apart support structures.

3. A windblown particle control device as defined in claim 1, wherein:

each of the webs has a three-dimensional characteristic; and the inherent strength of the sheet of netting material is imparted by the three-dimensional characteristics of the webs.

4. A windblown particle control device as defined in claim 1, wherein:

each of the webs has a three-dimensional characteristic with a width dimension, a thickness dimension and a length of dimension; and the width, thickness and length of dimensions of each of the webs establishes the inherent strength of the sheet of netting material to maintain the generally tubular cross-sectional shape.

5. A windblown particle control device as defined in claim 4, wherein:

the webs have substantially nonuniform thickness dimensions.

6. A windblown particle control device as defined in claim 5, wherein:

the webs also have substantially nonuniform width dimensions.

7. A windblown particle control device as defined in claim 4, wherein:

the sheet of netting material is formed by extrusion of the webs.

8. A windblown particle control device as defined in claim 4, wherein:

each of the webs and apertures is of substantially nonuniform characteristics relative to the majority of the other webs and apertures in the sheet of netting material.

9. A windblown particle control device as defined in claim 8, wherein:

the substantially nonuniform characteristics of the webs result from differences in shape, width, thickness and length of the webs in the sheet of netting material; and the substantial nonuniform characteristics of the webs and the substantial nonuniform characteristics of the apertures establish aerodynamic drag and turbulence altering effects in the wind flowing through the apertures.

10. A windblown particle control device as defined in claim 1, wherein:

the transverse dimension of the sheet of netting material is sufficient to extend the sheet of netting material completely around the outer peripheral shape of each frame structure when the sheet occupies the generally tubular cross-sectional shape.

11. A windblown particle control device as defined in claim 1, wherein:

the transverse dimension of the sheet of netting material is sufficient to extend the sheet of netting material around the outer peripheral shape of each frame structure to overlap opposite longitudinal edges of the sheet of netting material when the sheet occupies the generally tubular cross-sectional shape.

12. A windblown particle control device as defined in claim 1, wherein:

the transverse dimension of the sheet of netting material is sufficient to extend the sheet of netting material around the outer peripheral shape of each frame structure with a gap between opposite longitudinal edges of the sheet of netting material when the sheet occupies the generally tubular cross-sectional shape.

13. A windblown particle control device as defined in claim 12, wherein:

the gap extends on opposite sides of the anchor element of each frame structure.

14. A windblown particle control device as defined in claim 1, wherein:

the transverse dimension of the sheet of netting material is sufficient to extend the sheet of netting material around the outer peripheral shape of each frame structure to a position where opposite longitudinal edges of the sheet of netting material are spaced above the earth surface when the sheet occupies the generally tubular cross-sectional shape.

15. A windblown particle control device as defined in claim 14, wherein:

the longitudinal edges of the sheet of netting material which are spaced above the earth surface are located on opposite sides of the anchor element of each frame structure.

16. A windblown particle control device as defined in claim 1, wherein:

the outer peripheral shape of each frame structure is generally D-shaped.

17. A windblown particle control device as defined in claim 16, wherein:

the D-shaped outer peripheral shape of each frame structure includes a base portion which contacts the earth surface, two leg portions extending substantially vertically upward from the base portion, and a semicircular upper portion which extends between the leg portions.

18. A windblown particle control device as defined in claim 17, wherein:

an anchor element is connected to the frame structure at the junction of the base portion and a leg portion.

19. A windblown particle control device as defined in claim 18, wherein:

at least one frame structure of the device includes first and second anchor elements;

the first anchor element is connected to the frame structure at the junction of the base portion and one leg portion; and the second anchor element is connected to the frame structure at the junction of the base portion and the other leg portion.

20. A windblown particle control device as defined in claim 17, wherein:

the frame structure is formed from a wire having ends connected together to form an integral endless wire frame structure.

21. A windblown particle control device as defined in claim 20, wherein:

the anchor element comprises an anchor loop formed in the wire at the junction of the base portion and a leg portion; and the anchor loop receives a fastener to connect the anchor loop to the earth surface.

22. A windblown particle control device as defined in claim 1, wherein:

the outer peripheral shape of each frame structure is generally U-shaped.

23. A windblown particle control device as defined in claim 22, wherein:

the U-shaped outer peripheral shape of each frame structure includes two leg portions extending substantially vertically upward from the earth surface and a semicircular upper portion which extends between the leg portions.

24. A windblown particle control device as defined in claim 23, wherein:

an anchor element is connected to the frame structure at a location where the leg portion contacts the earth surface.

25. A windblown particle control device as defined in claim 24, wherein:

at least one frame structure of the device includes first and second anchor elements;

the first anchor element is connected to the frame structure at the location where one leg portion contacts the earth surface; and the second anchor element is connected to the frame structure at the location where the other leg portion contacts the earth surface.

26. A windblown particle control device as defined in claim 23, wherein:

the frame structure is formed from a wire forming an integral wire frame structure.

27. A windblown particle control device as defined in claim 26, wherein:

the anchor element comprises an anchor loop formed in an end of the wire at the location where one leg portion contacts the earth surface; and the anchor loop receives a fastener to connect the anchor loop to the earth surface.

28. A windblown particle control device as defined in claim 1, wherein:

the outer peripheral shape of each frame structure is generally O-shaped.

29. A windblown particle control device as defined in claim 28, wherein:

the O-shaped outer peripheral shape of each frame structure is generally circular.

30. A windblown particle control device as defined in claim 29, wherein:

an anchor element is connected to the frame structure at a lowermost position of the circular frame structure.

31. A windblown particle control device as defined in claim 29, wherein:

the frame structure is formed from a wire having ends connected together to form an integral endless generally circular wire frame structure.

32. A windblown particle control device as defined in claim 31, wherein:

the anchor element comprises an anchor loop formed in the generally circular wire frame structure; and the anchor loop receives a fastener to connect the anchor loop to the earth surface.

33. A windblown particle control device as defined in claim 31, wherein:

the circular wire frame structure comprises substantially spring wire.

34. A windblown particle control device as defined in claim 1, wherein:

each frame member defines a geometric configuration which extends the outer peripheral shape generally within a plane.

35. A windblown particle control device as defined in claim 34, wherein:

connection of each frame structure to the earth surface at the anchor element establishes a generally vertical orientation of the plane in which the outer peripheral shape extends.

36. A windblown particle control device as defined in claim 1, wherein:

each frame structure is formed as an integral unit.

37. A windblown particle control device as defined in claim 1, wherein:

the anchor element receives a fastener to connect the anchor element and the frame structure to the earth surface.

38. A windblown particle control device as defined in claim 37, wherein:

the fastener comprises a spike driven into the earth surface.

39. A windblown particle control device as defined in claim 1, further comprising:

a longitudinal restraint element connected to each of the longitudinally spaced apart frame structures and extending longitudinally beyond the longitudinal dimension of the sheet of netting material, the longitudinal restraint element including opposite longitudinal restraint connectors to connect the longitudinal restraint element to the earth surface.

40. A windblown particle control device as defined in claim 39, wherein:

the restraint connectors each receive a fastener to connect the longitudinal restraint element to the earth surface.

41. A windblown particle control device as defined in claim 40, wherein:

each restraint connector comprises a restraint loop connected to the longitudinal restraint element.

42. A windblown particle control device as defined in claim 39, wherein:

the longitudinal restraint element connects to one of the anchor elements attached to one of the frame structures of the device.

43. A windblown particle control device as defined in claim 39, wherein:

the longitudinal restraint element connects to all of the anchor elements attached to all of the frame structures of the device.

44. A windblown particle control device as defined in claim 39, wherein:

the longitudinal restraint element extends through the open center of at least one of the frame structures of the device.

45. A windblown particle control device as defined in claim 39, wherein:

the longitudinal restraint element extends through the open centers of all of the frame structures of the device.

46. A windblown particle control device as defined in claim 39, wherein:

the anchor element comprises an anchor loop attached to the frame structure; and the longitudinal restraint element extends through the anchor loop.

47. A windblown particle control device as defined in claim 39, wherein:

the anchor element comprises an anchor strap which extends around the frame structure and the longitudinal restraint element; and the anchor strap includes an aperture by which to attach the anchor strap to the earth surface.

48. A windblown particle control device as defined in claim 1, wherein:

at least one netting connector is formed by weaving the frame structure through the apertures in the sheet of netting material.

49. A windblown particle control device as defined in claim 1, wherein:

the sheet of netting material has a color which blends with a natural ambient environment adjacent to the location where the control device is attached to the earth surface.

50. A method of controlling particle cover stabilization and deposition and retention of particles blown by wind in a location on an earth surface that is to be protected, comprising:

using a windblown particle control device having a support structure formed by a plurality of separated frame structures arranged in a longitudinally spaced apart series and having an outer peripheral shape to which a sheet of netting material is connected, the sheet of netting material having a plurality of interconnected webs defining apertures through the sheet of netting material, the sheet of netting material extending unsupported between the outer peripheral shapes of the frame structures in a three dimensional porous tubular configuration having a longitudinal axis;

locating the control device relative to the area that is to be protected;

positioning the control device with the longitudinal axis of the porous tubular configuration extending generally parallel to the earth surface; and orienting the tubular configuration of the sheet of netting material to confront the wind and cause the wind blown particles to flow through the apertures of two vertically oriented portions of the tubular configuration of the sheet of netting material and create aerodynamic effects which stabilize, deposit and retain the particles on the earth surface in the protected area.

51. A method as defined in claim 50, further comprising:

depositing and retaining the particles substantially only in the protected area.

52. A method as defined in claim 50, further comprising:

anchoring the control device to the earth surface.

53. A method as defined in claim 52, further comprising:

connecting at least one of the frame structures of the device to the earth surface to anchor the control device to the earth surface.

54. A method as defined in claim 53, further comprising:

longitudinally restraining the frame structures of the device to the earth surface to anchor the control device to the earth surface.

55. A method as defined in claim 52, further comprising:

longitudinally restraining the frame structures of the device to the earth surface to anchor the control device to the earth surface.

56. A method as defined in claim 50, further comprising:

orienting the tubular configuration with the longitudinal axis generally perpendicular to a prevailing wind direction.

57. A method as defined in claim 50, further comprising:

positioning a plurality of the control devices in a row to deposit, stabilize, and retain the windblown particles in a protected area that is larger than the area capable of being protected by a single control device.

58. A method as defined in claim 57, further comprising:

longitudinally restraining to the earth surface the frame structures of all of the control devices in the row.

59. A method as defined in claim 58, further comprising:

anchoring to the earth surface each of the plurality of control devices positioned in the row independently of longitudinally restraining the frame structures of all of the control devices in the row.

60. A method as defined in claim 58, further comprising:

commonly longitudinally restraining to the earth surface the frame structures of all of the control devices in the row.

61. A method as defined in claim 57, further comprising:

positioning the plurality of the control devices end-to-end in a continuous row.

62. A method as defined in claim 57, further comprising:

positioning the plurality of control devices in a discontinuous row.

63. A method as defined in claim 57, further comprising:

positioning the plurality of control devices in a linear row.

64. A method as defined in claim 50, further comprising:

connecting the sheet of netting material to the frame structures by weaving the frame structure through the apertures in the sheet of netting material.

65. A method as defined in claim 50, further comprising:

selecting a color of the sheet of netting material which blends with a natural ambient environment adjacent to the location of the control device.

66. A method as defined in claim 52, wherein the sheet of netting material is extruded.

* * * * *